US008280279B2

(12) United States Patent
Mizuno et al.

(10) Patent No.: US 8,280,279 B2
(45) Date of Patent: Oct. 2, 2012

(54) PROCESS CARTRIDGE WITH FIRST, SECOND, AND THIRD PORTIONS-TO-BE-POSITIONED BY CORRESPONDING PORTIONS OF IMAGE FORMING APPARATUS

(75) Inventors: Tatsubumi Mizuno, Numazu (JP); Kazufumi Muto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 550 days.

(21) Appl. No.: 12/470,749

(22) Filed: May 22, 2009

(65) Prior Publication Data

US 2009/0290905 A1 Nov. 26, 2009

(30) Foreign Application Priority Data

May 23, 2008 (JP) ..... 2008-135684

(51) Int. Cl.
*G03G 21/16* (2006.01)

(52) U.S. Cl. ..... 399/111; 399/107; 399/112

(58) Field of Classification Search ..... 399/107, 399/111, 112
See application file for complete search history.

(56) References Cited

U.S. PATENT DOCUMENTS

| | | | | |
|---|---|---|---|---|
| 6,157,792 | A | 12/2000 | Mori et al. | 399/24 |
| 6,404,996 | B1 | 6/2002 | Mori et al. | 399/24 |
| 7,024,133 | B2 | 4/2006 | Nagashima et al. | 399/111 |
| 7,072,602 | B2 * | 7/2006 | Hatori et al. | 399/111 |
| 7,480,747 | B2 | 1/2009 | Bell et al. | 399/175 |
| 2008/0138107 | A1 * | 6/2008 | Mori et al. | 399/111 |
| 2009/0028601 | A1 | 1/2009 | Mizuno et al. | 399/111 |
| 2009/0116869 | A1 | 5/2009 | Kotsuka et al. | 399/111 |
| 2010/0290806 | A1 * | 11/2010 | Yamaguchi et al. | 399/111 |

FOREIGN PATENT DOCUMENTS

JP 2004-212986 7/2004

* cited by examiner

*Primary Examiner* — Ryan Walsh
(74) *Attorney, Agent, or Firm* — Fitzpatrick, Cella, Harper & Scinto

(57) ABSTRACT

An image forming apparatus forms an image on a recording material, detachably mounts a process cartridge including a photosensitive drum, and includes first and second positioning portions respectively positioning the drum upstream and downstream with respect to a cartridge mounting direction, a coupling engaging a drum coupling and transmitting a driving force to the drum, and a support supporting the cartridge at a first position positioning the drum to the first and second positioning portions and at a second position spacing the drum away from the first and second positioning portions to permit cartridge mounting and dismounting. The support includes a guide engaging the cartridge, and a third positioning portion limiting cartridge rotation relative to the first and second positioning portions when the coupling transmits a driving force to the drum coupling and for positioning the cartridge lower portion at an upstream position with respect to the mounting direction.

14 Claims, 18 Drawing Sheets

PROCESS CARTRIDGE WITH FIRST, SECOND, AND THIRD PORTIONS-TO-BE-POSITIONED BY CORRESPONDING PORTIONS OF IMAGE FORMING APPARATUS

FIELD OF THE INVENTION AND RELATED ART

The present invention relates to an image forming apparatus, such as a copying machine, a printer, and a facsimile machine, etc., in which a process cartridge is removably mountable. It also relates to a process cartridge.

There have been available various image forming apparatuses which form a toner image (an image formed of toner). Some of them are structured so that a process cartridge or process cartridges are removably mountable in their main assembly. Further, some of them have been known to have been structured in consideration of the ease with which a process cartridge or process cartridges can be mounted into the main assembly of an image forming apparatus, or the ease with which a process cartridge or process cartridges in the main assembly of an image forming apparatus can be replaced.

Further, some image forming apparatuses are structured so that a process cartridge is mounted into, or removed from, their main assembly, through the opening with which one of their side walls is provided, in a direction parallel to the lengthwise direction of the process cartridge. Further, some of the image forming apparatuses structured as described above are provided with a process cartridge guide or process cartridge guides which supports or support a process cartridge from under the process cartridge (Japanese Laid-open Patent Application 2004-212986). Regarding the prior technologies related to the above described structural features of the image forming apparatuses, an image forming apparatus is provided with a door which can be opened to expose the abovementioned opening for mounting or dismounting a process cartridge, or to cover the opening. More specifically, an image forming apparatus is structured so that as the door is moved into its closed position after the mounting of a process cartridge into the main assembly of an image forming apparatus, the image bearing member of the process cartridge is precisely moved into its image forming position in the main assembly, by the closing movement of the door. Further, in order to prevent the image bearing member from being damaged while the process cartridge is mounted into, or removed from, the main assembly, the image forming apparatus is structured so that the abovementioned guides for supporting the process cartridge from under the process cartridge are movable to keep the image bearing member separated from the apparatus main assembly while the process cartridge is mounted into, or removed from, the apparatus main assembly.

In order for an image forming apparatus to form images of excellent quality, the image forming apparatus has to be structured so that an image bearing member is highly precisely positioned relative to the main assembly of the image forming apparatus. Further, the image forming apparatus has to be structured so that the process cartridge is precisely positioned in terms of its attitude relative to the main assembly. That is, the image forming apparatus and the process cartridge therefor have to be structured so that the process cartridge is held in its preset position in the main assembly without causing the processing means (charging means, developing means, cleaning means, etc.) in the process cartridge to be misaligned relative to the image bearing member.

Generally, an image forming apparatus and a process cartridge therefor are structured so that the process cartridge is precisely positioned relative to the main assembly of the image forming apparatus (which hereafter will be referred to simply as an apparatus main assembly) to precisely position the image bearing member in the process cartridge relative to the apparatus main assembly, and also, so that the process cartridge is rotated about the axial line of the image bearing member to precisely fix the process cartridge in its attitude relative to the apparatus main assembly. More concretely, for example, the apparatus main assembly is provided with a pair of image bearing member positioning portions, which are in the form of a pair of bearing catching recesses or holes for catching the bearings of the image bearing member. Thus, as the bearings of the image bearing member are caught by the bearing catching portions of the main assembly, the image bearing member becomes precisely positioned relative to the main assembly. As for the rotation stopper for precisely fixing the process cartridge in its attitude relative to the apparatus main assembly by catching the process cartridge as the process cartridge is rotated about the axial line of its image bearing member, conventionally, a process cartridge is provided with a boss which protrudes from the lengthwise ends of the external frame (shell) of the process cartridge, whereas the apparatus main assembly is provided with a pair of holes which are elongated in cross section. As the abovementioned bosses are fitted in these holes, one for one, the process cartridge becomes fixed in attitude. In the case of some image forming apparatuses and the process cartridge therefor, the process cartridge is provided with the above-mentioned holes with elongated cross section, and their main assembly is provided with the bosses.

Also regarding the above described background technologies, as far as fixing in attitude the downstream end portion (in terms of cartridge mounting direction) of a process cartridge relative to the rear end of the apparatus main assembly is concerned, a highly precise rotation stopping means, which is relatively small in component count, can be realized by structuring an image forming apparatus and a process cartridge therefor so that the boss protruding from the external frame of the process cartridge fits into a hole with elongated cross section, with which the rear panel of the apparatus main assembly is provided. However, it has been difficult to provide a rotation stopping means capable of highly precisely fixing in attitude the upstream end portion of a process cartridge relative to the apparatus main assembly, because the front end of the apparatus main assembly has the opening for mounting or dismounting the process cartridge. Besides, structuring an image forming apparatus and a process cartridge therefor so that the process cartridge is precisely fixed in attitude relative to the apparatus main assembly, only at the rear end of the apparatus main assembly, is not satisfactory to precisely position the process cartridge relative to the apparatus main assembly, and precisely fix the process cartridge in attitude relative to the apparatus main assembly.

Some image forming apparatuses, and the process cartridges therefor, are structured so that the front door is provided with means for precisely positioning a process cartridge relative to the apparatus main assembly, and also, in terms of attitude. This cartridge positioning structural arrangement also is affected by the accuracy with which the door is attached to the apparatus main assembly. Therefore, it was also difficult to precisely position a process cartridge relative to the main assembly of an image forming apparatus with use of this structural arrangement.

SUMMARY OF INVENTION

The present invention was made in light of the above described problems. Thus, the primary object of the present invention is to provide a combination of an image forming apparatus and a process cartridge, which is structured so that the process cartridge is mounted into, or removed from, the main assembly of the image forming apparatus in the direction parallel to the axial line of the photosensitive drum in the process cartridge; is simple in structure; and yet, is capable of highly precisely positioning the process cartridge relative to the apparatus main assembly.

According to an aspect of the present invention, there is provided an image forming apparatus for forming an image on a recording material. A process cartridge including a photosensitive drum and process means actable on the photosensitive drum is detachably mountable to a main assembly of the image forming apparatus in a direction of an axis of the photosensitive drum. The image forming apparatus comprises a first positioning portion, a second positioning portion, a main assembly coupling, and a supporting member. The first positioning portion is provided above the process cartridge, to position, with respect to a direction crossing the axis of the photosensitive drum, the photosensitive drum at an upstream position upstream of the second positioning portion with respect to a mounting direction in which the process cartridge is mounted to the main assembly of the apparatus. The second positioning portion is provided above the process cartridge at a downstream position downstream of the first positioning portion with respect to the mounting direction, and positions the photosensitive drum with respect to a direction crossing the axis of the photosensitive drum. The main assembly coupling is provided at a downstream position downstream of the first positioning portion with respect to the mounting direction, and engages a drum coupling provided at an end of the photosensitive drum and transmits a driving force to the photosensitive drum. The supporting member supports the process cartridge at a first position for positioning the photosensitive drum to the first positioning portion and the second positioning portion and at a second position for spacing the photosensitive drum away from the first positioning portion and the second positioning portion to permit mounting and dismounting the process cartridge relative to the main assembly of the apparatus. The supporting member includes a guide portion that engages a portion-to-be-guided provided at a bottom portion of the process cartridge to guide the process cartridge along the mounting direction. The supporting member also includes a third positioning portion that limits rotation of the process cartridge relative to the first positioning portion and the second positioning portion when the main assembly coupling transmits a driving force to the drum coupling and that positions the bottom portion of the process cartridge at an upstream position upstream of the second positioning portion with respect to the mounting direction.

According to another aspect of the present invention, there is provided a process cartridge detachably mountable to a main assembly of an image forming apparatus. The main assembly includes a main assembly coupling, a first positioning portion, a second positioning portion, a supporting member movable between the first position and the second position and provided below the first positioning portion and the second positioning portion. The supporting member includes a guide portion and a third positioning portion. The cartridge comprises a photosensitive drum, and a process device actable on the photosensitive drum. The cartridge also includes a drum coupling, provided at an end of the photosensitive drum, that engages the main assembly coupling at a downstream position downstream of the first positioning portion with respect to a mounting direction in which the process cartridge is mounted to the main assembly and which is substantially parallel with a direction of an axis of the photosensitive drum. The cartridge further includes a first portion-to-be-positioned, provided at a first portion of the process cartridge, to be positioned with respect to a direction crossing with the axis of the photosensitive drum by contacting the first positioning portion at a position upstream of the second positioning portion with respect to the mounting direction when the supporting member supporting the process cartridge is at the first position. The cartridge also includes a second portion-to-be-positioned, provided at the first portion of the process cartridge, to be positioned with respect to a direction crossing the axis of the photosensitive drum by contacting the second positioning portion at a position downstream of the first positioning portion with respect to the mounting direction when the supporting member supporting the process cartridge is at the first position. In addition, the cartridge includes a portion-to-be-guided engageable with the guide portion to be guided in a direction of the axis of the photosensitive drum when the process cartridge is mounted to the main assembly. The cartridge also includes a third portion-to-be-positioned, provided at a second portion of the process cartridge, lower than the first portion of the process cartridge and that is limited by the third positioning portion to prevent rotation of the process cartridge relative to the first positioning portion and the second positioning portion at an upstream position upstream of the second positioning portion with respect to the mounting direction when the main assembly coupling transmits a driving force to the drum coupling.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

Embodiment 1

Figure 1:
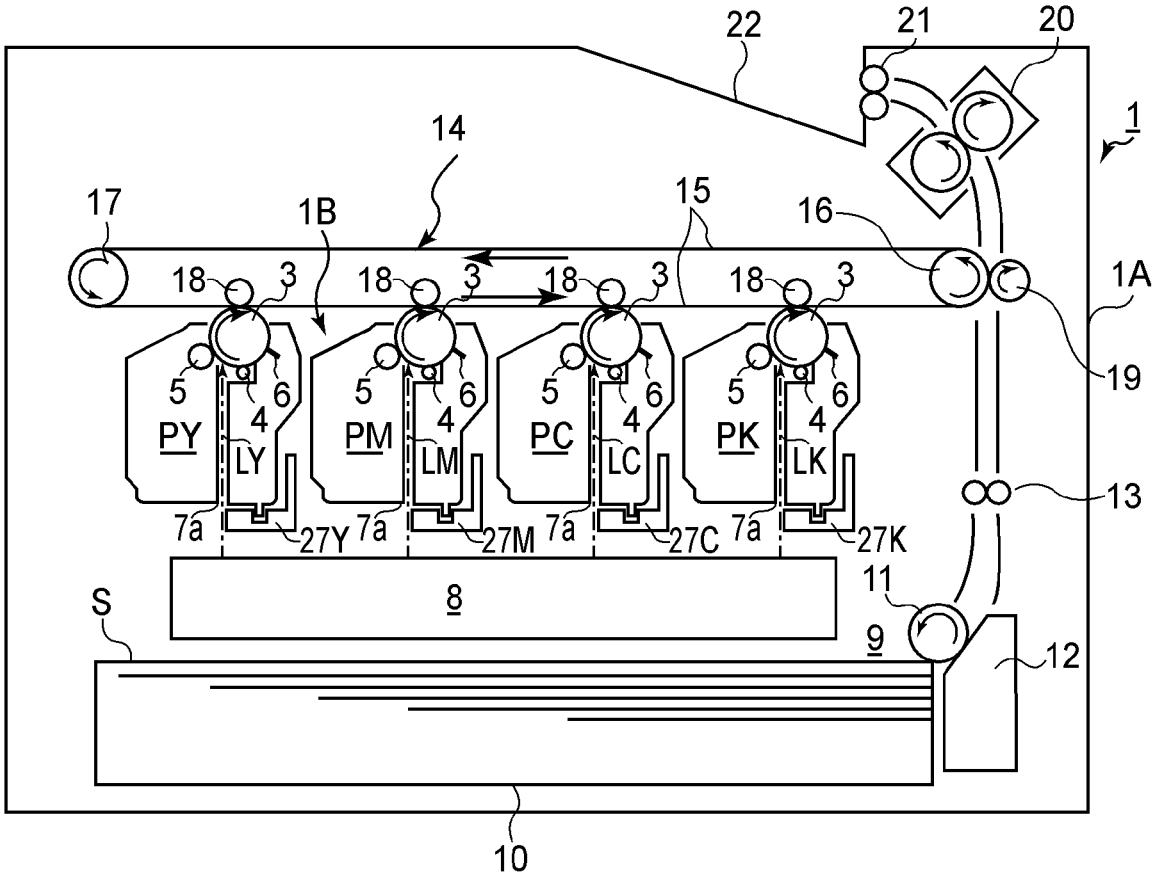
FIG. 1 is a schematic vertical sectional view of the image forming apparatus in the first preferred embodiment, at a plane parallel to the front panel of the image forming apparatus.
Figure 2:
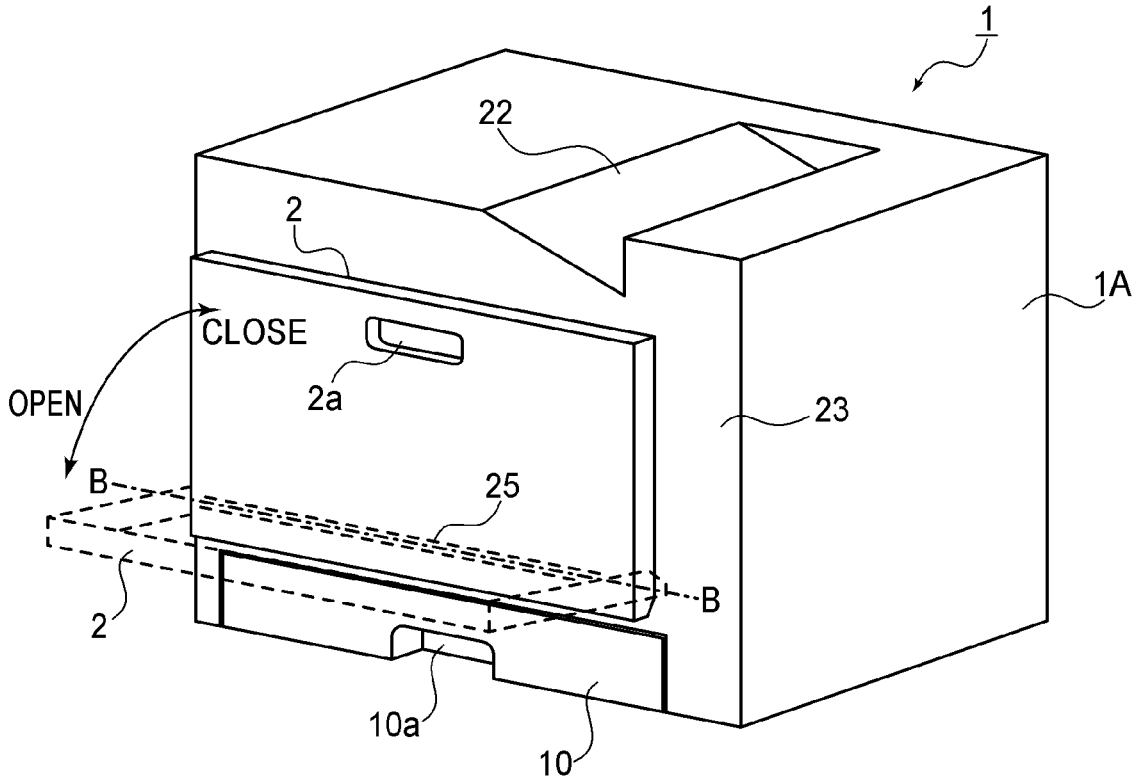
FIG. 2 is an external perspective view of the image forming apparatus in the first preferred embodiment, when the front door of the image forming apparatus is shut.
Figure 3:
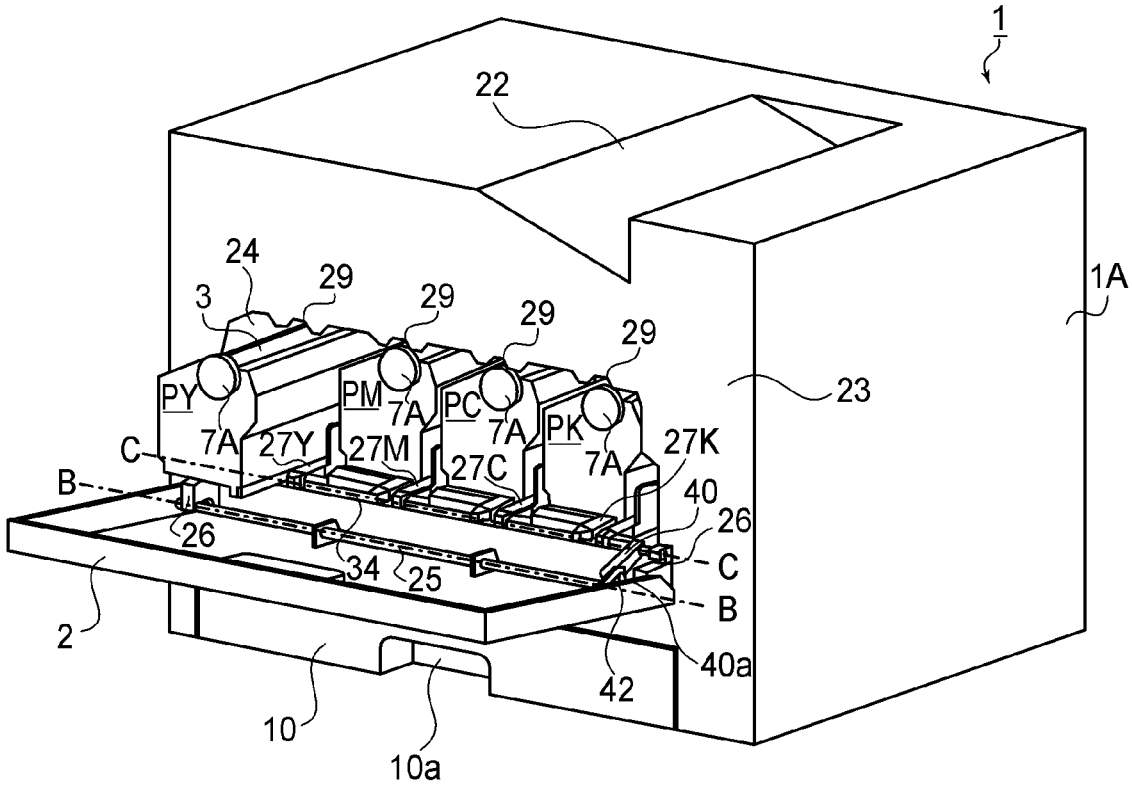
FIG. 3 is an external perspective view of the image forming apparatus in the first preferred embodiment, when the front door of the apparatus is completely open, and the first process cartridge has just been halfway pulled out of the apparatus main assembly.

FIG. 1 is a schematic vertical sectional view of the image forming apparatus in the first preferred embodiment, at a plane parallel to the front panel of the image forming apparatus. FIG. 2 is an external perspective view of the image forming apparatus in the first preferred embodiment, when the front door of the image forming apparatus is shut. FIG. 3 is an external perspective view of the image forming apparatus in the first preferred embodiment, when the front door of the apparatus is completely open, and the first process cartridge has just been halfway pulled out of the apparatus main assembly.

This image forming apparatus 1 is a full-color laser beam printer, which uses an electrophotographic process and four monochromatic toners. It forms a color image on recording medium. It uses four process cartridges P (first to fourth process cartridge PY, PM, PC, and PK). Further, the image forming apparatus 1 and the process cartridges therefor are structured so that the cartridges are removably mountable in the main assembly of the image forming apparatus 1.

In the following description of the preferred embodiments of the present invention, the front side, or user side, of the image forming apparatus is the side where the door which is for covering or exposing the process cartridge chambers of the apparatus main assembly is located. The backside, or rear side, is the opposite side from the front side. Further, the front-to-rear direction means both the direction from the rear side to the front side (frontward), and the opposite (rearward) direction from the frontward direction. The left and right sides of the image forming apparatus 1 means the left and right sides of the apparatus as seen from the front side of the apparatus. Further, the left-to-right direction means both the leftward direction, that is, the direction from the right to left, and the opposite direction (rightward direction), that is, the direction from the left side to the right side. Further, the image forming apparatus main assembly 1A (which hereafter will be referred to simply as apparatus main assembly 1A) is the portion of the image forming apparatus excluding the process cartridges. Further, the lengthwise direction of a process cartridge (which hereafter will be referred to simply as cartridge), structural components of the process cartridge, or structural components of the apparatus main assembly, means the direction of the axial line of the image bearing member of the process cartridge, which is in the form of an electrophotographic photosensitive drum, or the direction parallel to the axial line of the image bearing member, when the process cartridge is in the apparatus main assembly. Regarding the cartridge P, its lengthwise end to which the cartridge driving force is transmitted from the apparatus main assembly 1A may be referred to as driven end, and the opposite end from the driven end may be referred to as non-driven end.

The apparatus main assembly 1A is provided with cartridge chamber 1B in which the first to fourth cartridges PY, PM, PC, and PK are placed. The cartridge chamber 1B occupies roughly the center portion of the apparatus main assembly 1A.

The first to fourth cartridges P (PY, PM, PC, and PK) are disposed in the cartridge chambers 1B in such a manner that their lengthwise direction is perpendicular to the left-to-right direction of the apparatus main assembly 1A, and also, that they are horizontally aligned in tandem in the left-to-right direction. Further, they are precisely position for image formation.

The four cartridges P are the same in structure, being designed to carry out the electrophotographic process, but are different in the color and amount of the developer (which hereafter may be referred to as toner) they contain. To each of the four cartridges P precisely positioned for image formation in the cartridge chamber 1B, rotational driving force is transmitted from one of the couplings 51 (FIG. 19) with which the apparatus main assembly 1A is provided. Further, each of the four cartridges P is supplied with biases (charge bias, development bias, etc.) (unshown).

Each process cartridge P in this embodiment is made up of a drum 3, a charging means 4, a developing means 5, a cleaning means 6, and an external frame 7 (shell 7). The charging means, 4, developing means 5, and cleaning means 6 are the means for processing the drum 3, and are integrally disposed, along with the drum 3, in the external frame 7 (shell 7). As the charging means 4, a charge roller is used. As the developing means 5, a development roller is used. As the cleaning means 6, a cleaning blade is used.

Figure 4:
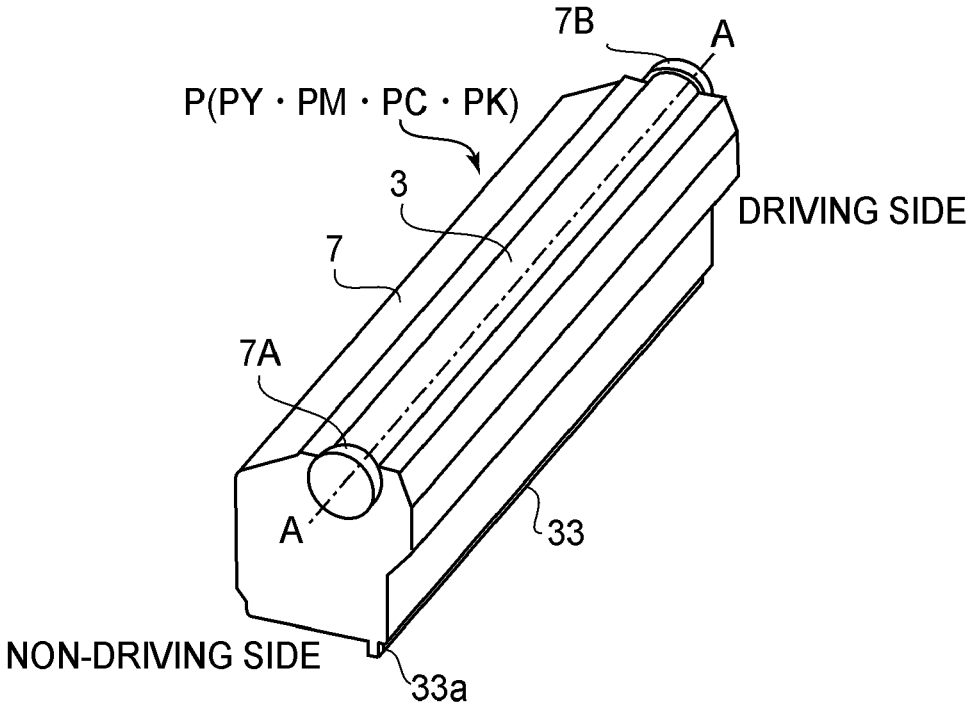
FIG. 4 is an external perspective view of one of the cartridges for the image forming apparatus in the first preferred embodiment, as seen from the opposite lengthwise end of the cartridge, from which the cartridge is driven.

FIG. 4 is an external perspective view of one of the cartridges for the image forming apparatus in the first preferred embodiment, as seen from the non-driven end. The cartridge P is an assembly, the lengthwise direction of which is parallel to the direction A-A of the drum 3 in the cartridge P. The drum 3 is rotatably supported by the external cartridge frame 7. More specifically, the external frame 7 is provided with first and second bearings 7A and 7B, which are attached to the lengthwise ends of the frame 7, one for one. The end portion of the drum 3, from which the drum 3 is not driven, is supported by the first bearing 7A, and the end portion of the drum 3, from which the drum 3 is driven, is supported by the second bearing 7B.

The first cartridge PY has a developer container in which yellow (Y) toner is stored. It forms a toner image of yellow color, on the peripheral surface of the drum 3. The second cartridge PM has a developer container in which magenta (M) toner is stored. It forms a toner image of magenta color, on the peripheral surface of the drum 3. The third cartridge PC has a developer container in which cyan (C) toner is stored. It forms a toner image of cyan color, on the peripheral surface of the drum 3. The fourth cartridge PK has a developer container in which black (K) toner is stored. It forms a toner image of black color, on the peripheral surface of the drum 3.

The apparatus main assembly 1A is provided with a laser scanner 8, which is located below cartridge chamber 1B. The laser scanner 8 is a means for exposing the peripheral surface of the drum 3 in each cartridge P, with the beam of laser light modulated with the information regarding the image to be formed.

The apparatus main assembly 1A is also provided with a recording medium feeding unit 9, which is located below the laser scanner 8. The recording medium feeding unit 9 has a recording paper feeding cassette 10, in which sheets S of a recording medium (a transfer medium) are storable in layers, a combination of a sheet feeding roller 11 and a sheet separating portion 12, a pair of registration rollers 13, etc.

Further, the apparatus main assembly 1A has an intermediary transfer unit 14, which is located above the cartridge chamber 1B. The unit 14 is a means for transferring in layers (primary transfer) the toner images formed on the drums 3 in the first to fourth cartridges P (PY, PM, PC, and PK) onto an intermediary transfer belt 15 (first recording medium, which hereafter will be referred to simply as belt 15). The intermediary transfer unit 14 has a pair of rollers, that is, a driver roller 16 and a tension roller 17, which are disposed in parallel in the right and left end portions of the apparatus main assembly 1A, and a flexible and endless belt 15, which is suspended by the two rollers 16 and 17 in such a manner that the portion of the belt 15, which is circulating through the bottom portion of the belt loop, remains horizontal.

Each cartridge P is precisely placed in its image forming position in the cartridge chamber 1B. As the cartridge P is precisely placed in its image forming position, its drum 3 is placed in contact with the portion of the belt 15, which corresponds in position to the bottom portion of the belt loop. The point (portion) of contact between the drum 3 and the belt 15 is the primary transfer point (portion). The intermediary transfer unit 14 is also provided with four primary transfer rollers 18, which are located in the inward side of the loop of the belt 15, being positioned so that they oppose the four drums 3, one for one, with the presence of the belt 15 between each primary transfer roller 18 and the corresponding drum 3. The belt 15 is circularly driven by the driver roller 16 in the counterclockwise direction, indicated by an arrow mark, at the speed which matches the rotational speed of the drum 3, while remaining in contact with all of the four drums 3, by the portion which corresponds to the bottom portion of the belt loop, across the highest portion of the peripheral surface of each drum 3. To the primary transfer roller 18, a preset primary transfer voltage is applied with a preset control timing. Further, the apparatus main assembly 1A is provided with a secondary transfer roller 19, which is positioned in contact with the belt 15 in such a manner that it is kept pressed against the driver roller 16, with the presence of the belt 15 between the two rollers 19 and 16. The point (portion) of contact between the secondary transfer roller 19 and the belt 15 is the secondary transfer point (portion). To the secondary transfer roller 19, a preset secondary transfer voltage is applied with the preset control timing.

Further, the apparatus main assembly 1A is provided with a fixation unit 20 and a recording medium sheet discharging unit 21, which are located in the top right portion of the apparatus main assembly 1A. A part of the top surface of the external frame of the apparatus main assembly 1A is designed as a delivery tray 22.

The full-color image forming operation of the image forming apparatus 1 is as follows: First, the controller (unshown control circuit) causes the image forming apparatus 1 to start an image forming operation, in response to a print signal. As the image forming operation is started, the drums 3 in the first to fourth cartridges P (PY, PM, PC, and PK) are rotationally driven at a preset peripheral velocity in the clockwise direction, indicated by the arrow mark, and the belt 15 is circularly driven also in the clockwise direction (so that it moves in the same direction as the peripheral surface of the drum 3, in the interface between them), indicated by another arrow mark, at the speed which matches the peripheral velocity of the drum 3. Further, the laser scanner 8 is started. In synchronism with the driving of the above-mentioned components, the peripheral surface of the drum 3 in each cartridge p is uniformly charged to a preset polarity and potential level by the charge roller 4 to which a preset charge voltage is being applied. The uniformly charged portion of the peripheral surface of each drum 8 is exposed by one of the beams of laser light L (LY, LM, LC, and LK) projected by the laser scanner 8 while being modulated with signals which carry the information of an image to be formed. More specifically, as the beams of laser light LY, LM, LC, and LK outputted from the laser scanner 8 enter the cartridges PY, PM, PC, and PK, correspondingly, through the slit 7*a*, with which each cartridge P is provided, they illuminate the drums 3 across the bottom portion of the peripheral surface of the drum 3. As a result, an electrostatic latent image is formed on the peripheral surface of each drum 3. Each electrostatic latent image reflects the signals modulated with the information regarding the image to be formed. Then, each electrostatic latent image is developed by the development roller 5 into a visible image, that is, a monochromatic image formed of toner.

Through the above described image forming operation, which uses the electrophotographic process, a yellow toner image is formed on the drum 3 of the first cartridge PY, which corresponds to the yellow component of the full-color image to be formed. This toner image is transferred (primary transfer) onto the belt 15. Similarly, a magenta toner image is formed on the drum 3 of the second cartridge PM, which corresponds to the magenta component of the full-color image to be formed. This toner image is transferred (primary transfer) onto the belt 15 in such a manner that it is overlaid on the yellow toner image having just been transferred onto the belt 15. Similarly, a cyan toner image is formed on the drum 3 of the third cartridge PC, which corresponds to the cyan component of the full-color image to be formed. This toner image is transferred (primary transfer) onto the belt 15 in such a manner that it is overlaid on the yellow and magenta toner images having just been transferred in layers onto the belt 15. Further, a black toner image is formed on the drum 3 of the fourth cartridge PK, which corresponds to the black component of the full-color image to be formed. This toner image is transferred (primary transfer) onto the belt 15 in such a manner that it is overlaid on the yellow, magenta, and cyan toner images having just been transferred in layers onto the belt 15.

As a result, an unfixed full-color toner image is synthetically formed on the belt 15, and is composed of the yellow, magenta, cyan, and black monochromatic toner images.

The transfer residual toner, that is, the toner remaining on the peripheral surface of the drum 3 in each cartridge P after the primary transfer, is removed by the cleaning blade 6.

Meanwhile, one of the recording sheets S in the sheet feeding cassette 10 of the sheet feeding unit 9 is separated from the rest of the recording sheets S in the cassette 10, and is fed into the apparatus main assembly 1A. As the recording sheet S is fed into the apparatus main assembly 1A, it is conveyed to the pair of registration rollers 13, and then, is introduced by the registration rollers 13 into the secondary transfer portion, which is the interface between the belt 15 and secondary transfer roller 19. To the secondary transfer roller 19, a preset secondary transfer voltage is applied. As a result, the four layers of an unfixed monochromatic toner image, different in color, on the belt 15 are transferred together (secondary transfer) onto the surface of the recording medium sheet S as if they are peeled away from the belt 15.

Then, the recording medium sheet S is separated from the surface of the belt 15, and is conveyed into the fixation unit 20, in which the recording medium sheet S and the unfixed images thereon are subjected to heat and pressure. As a result, the unfixed toner images become fixed to the recording medium sheet S. Then, the recording medium sheet S is conveyed out of the fixation unit 20, and is discharged, as a full-color copy of the image to be formed, onto the delivery tray 22 by the sheet discharging unit 21.

<Exchange of Process Cartridge>

The toner in the developing means of each of the cartridges P in the apparatus main assembly 1A is consumed as the cartridges are used for image formation. Thus, each cartridge P is provided with a detecting means (unshown) for detecting the amount of the toner remaining in the cartridge. The detected amount of the toner in each cartridge P is compared by the controller with the threshold value set up for issuing a prescribed warning message, which informs a user of the nearness to the end of the service life of the cartridge P, the actual end of the service life of the cartridge P, etc. If the controller determines that the detected amount of the toner in the cartridge P is no more than the abovementioned threshold value, it makes the display portion (unshown) of the apparatus main assembly 1A display the abovementioned warning messages, to suggest to a user that a replacement cartridge for the cartridge in the apparatus main assembly 1A be prepared, or that the cartridge in the apparatus main assembly 1A be replaced to ensure that the image forming apparatus continues to output high quality images.

The operation for replacing any of the cartridges P in the image forming apparatus 1 is as follows: The cartridge P in the apparatus main assembly 1A is to be replaced from the front side of the apparatus main assembly 1A by opening the front door of the apparatus main assembly 1A as shown in FIG. 3. More specifically, designated by a referential code 2*a* is a handhold portion of the front door 2. Incidentally, the image forming apparatus 1 is structured so that the recording medium sheet feeding cassette 10 of the recording medium sheet feeding unit 9 is also to be inserted or removed from the front side of the apparatus main assembly 1A. Designated by a referential code 10*a* is the handhold portion of the recording sheet feeding cassette 10.

The front panel 23 of the apparatus main assembly 1A is provided with an opening 24, through which the cartridge P is inserted into, or removed from, the apparatus main assembly 1A. The direction in which the cartridge P is mounted into, or removed from, the apparatus main assembly 1A is parallel to the axial line of the drum 3.

Further, the front panel 23 of the apparatus main assembly 1A is provided with the door 2 (front door), which is movable between the closed position in which it keeps the opening 24 completely covered, and the open position in which it keeps the opening 24 fully exposed.

The front door 2 in this embodiment is rotatably supported by a door axle 25 (first rotational shaft) located at the bottom edge of the front door 2. The door axle 25 is rotatably supported by a pair of bearings 26, with which the front panel of the apparatus main assembly 1A is provided. In this embodiment, in consideration of the operational convenience for a user, the door axle 25 is attached to the front panel 23 in such a manner that its axial line B-B is horizontal and parallel to the left-to-right direction of the apparatus main assembly 1A. Thus, the front door 2 can be changed in attitude by being rotated frontward roughly 90° about the rotational axle 25, from the one in which it is folded up against the front panel 23 of the apparatus main assembly 1A, being therefore roughly vertical, into the one in which it is roughly horizontal.

Figure 5:
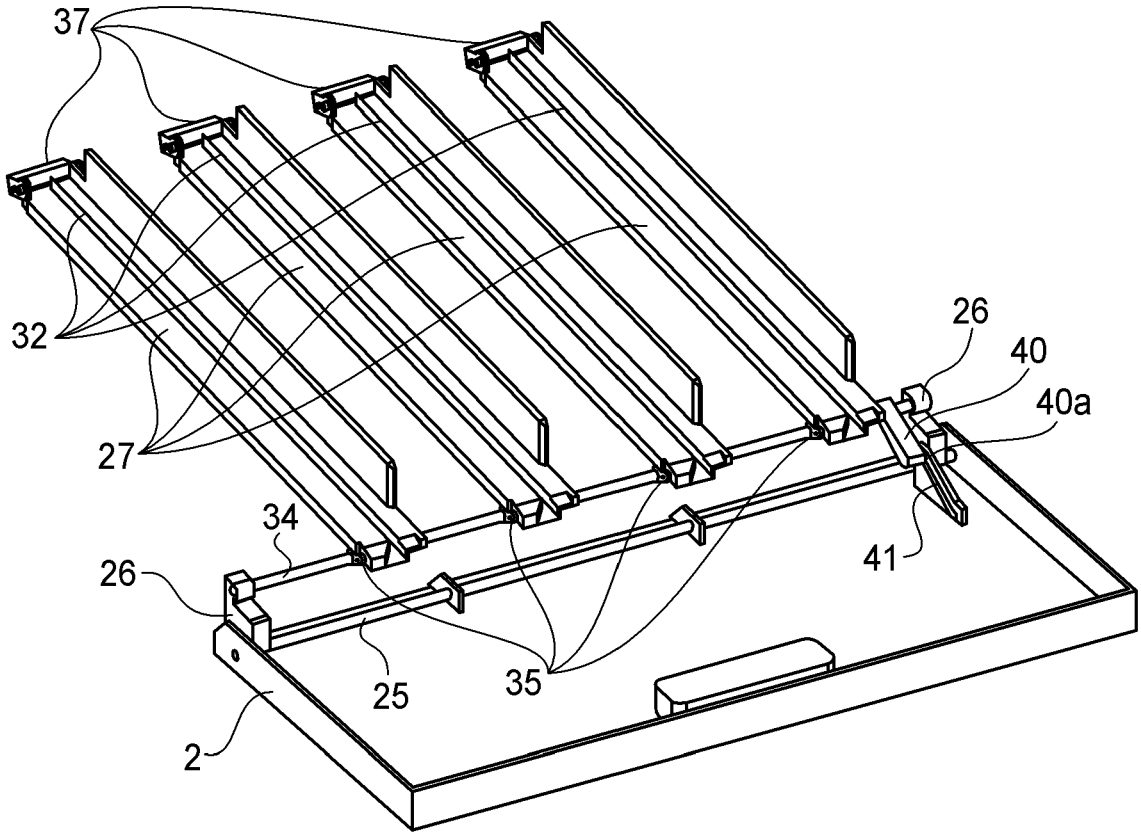
FIG. 5 is a perspective view of the first to fourth cartridge supporting members of the apparatus main assembly, and the front door (which is open) of the apparatus main assembly.

The cartridge chamber 1B of the apparatus main assembly 1A is provided with the first to fourth cartridge supporting members 27 (27Y, 27M, 27C, and 27K), which are for supporting the first to fourth cartridges P (PY, PM, PC, and PK), correspondingly. FIG. 5 is a perspective view of the cartridge supporting members 27 (which hereafter may be referred to simply as supporting members 27) and the adjacencies of the front door 2.

Each supporting member 27 is horizontally disposed in the same direction as the first to fourth cartridges P (PY, PM, PC, and PK).

Further, each supporting member 27 is movable between its first and second positions by a supporting member moving mechanism, the movement of which is linked to the opening and closing movement of the front door 2. The first position of the supporting member 27 is the position into which the supporting member 27 is moved to precisely position the cartridge P relative to the apparatus main assembly 1A, for image formation. The second position of the supporting member 27 is the position into which the supporting member 27 is moved to make it possible for the cartridge P to be mounted into, or removed from, the apparatus main assembly 1A. Further, the first position of the supporting member 27 is the position into which the supporting member 27 is moved by the closing movement of the front door 2 to place the drum 3 in contact with the belt 15, and the second position of the supporting member 27 is the position into which the supporting member 27 is moved by the opening movement of the front door 2 to keep the drum 3 away from the belt 15.

The direction in which each supporting member 27 is moved is vertical, that is, perpendicular to the abovementioned direction in which the cartridges P are inserted into, or removed from, the apparatus main assembly 1A. The supporting member moving mechanism, the movement of which is linked to the opening and closing movement of the front door 2, will be described later.

In this embodiment, as the front door 2 is rotationally closed, each supporting member 27 is moved up into the first position by the supporting member moving mechanism, which is moved by the closing movement of the front door 2, whereas as the front door 2 is rotationally opened, each supporting member 27 is moved down into the second position by the supporting member moving mechanism, which is moved by the opening movement of the front door 2.

Figure 7:
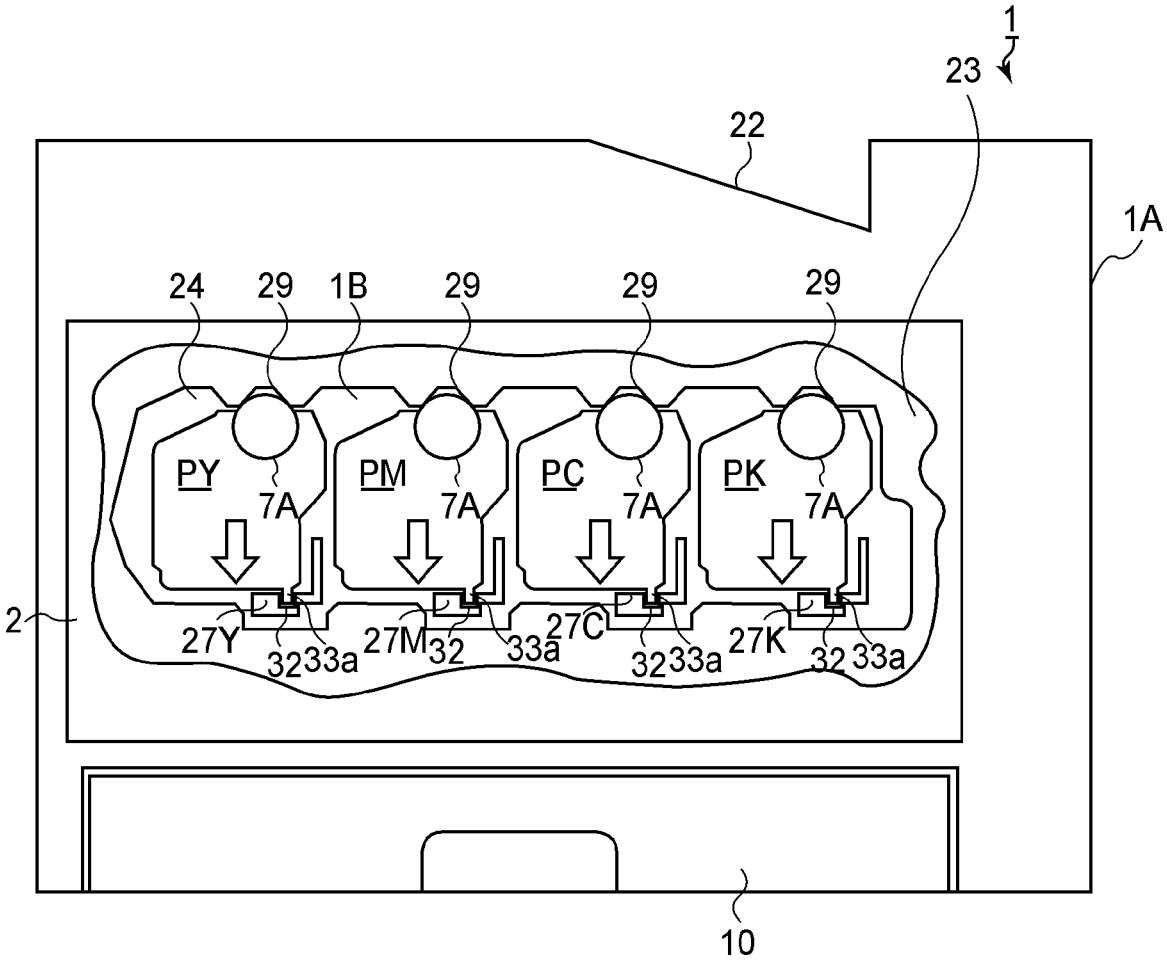
FIG. 7 is a phantom drawing of the image forming apparatus, and the four process cartridges having just been precisely positioned in the apparatus main assembly.
Figure 12:
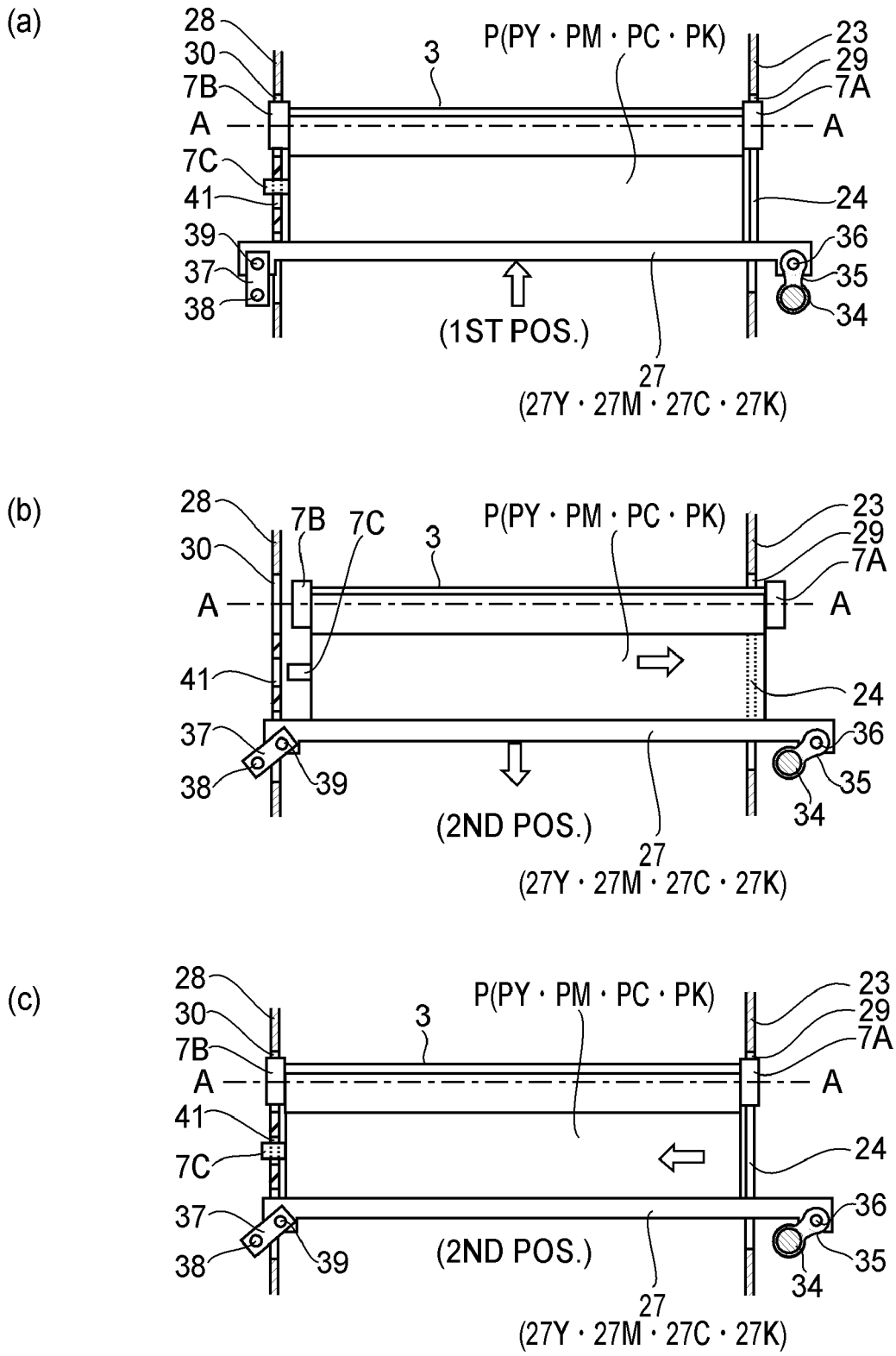
FIGS. 12(*a*)-12(*c*) are schematic drawings for describing the relationship between the movement of the cartridge supporting member and the cartridge, when the cartridge is mounted into, or removed from, the apparatus main assembly.
Figure 19:
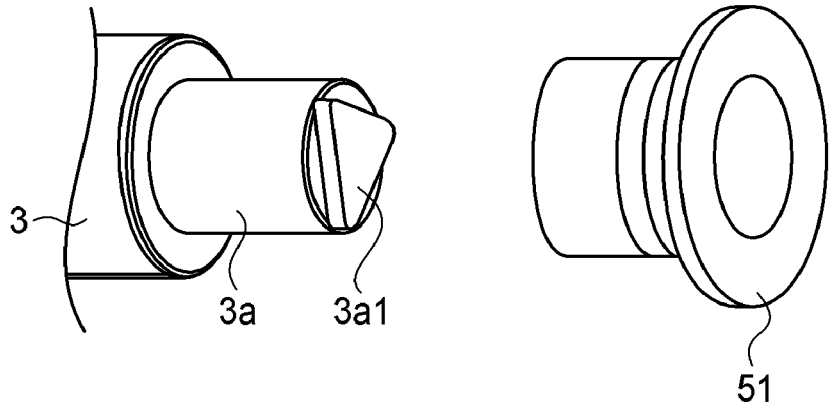
FIG. 19 is a perspective view of the coupling in the first preferred embodiment.
Figure 19:
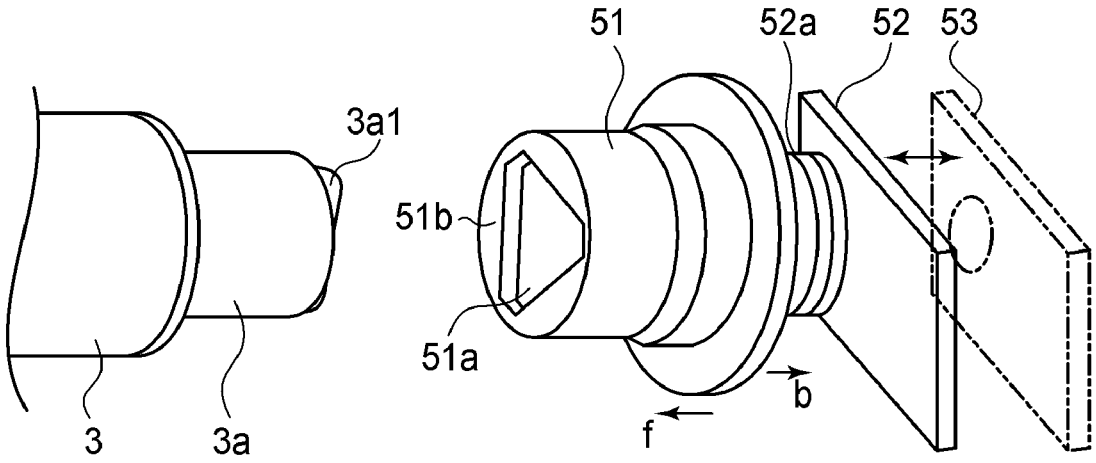

FIGS. 7 and 12(*a*) depict the state of the image forming apparatus 1, in which each supporting member 27 is in the first position into which it was moved up. When the supporting member 27 in is its first position, the corresponding cartridge P is kept in its position in which the top portion of the first bearing 7A (which is located at one of lengthwise end of cartridge P), is kept pressed upon one of the first cartridge positioning portions 29 (cartridge catching portions), with which the front panel 23 of the apparatus main assembly 1A is provided, and also, in which the top portion of the second bearing 7B (which is located at other lengthwise end of cartridge P), is kept pressed upon one of the second cartridge positioning portions 30 (cartridge catching portion), with which the rear panel 28 of the apparatus main assembly 1A is provided. The first positioning portion 29 is a recess in the form of a V-shaped valley. It is with these recess portions of the front and rear panels of the apparatus main assembly 1A that the first and second bearings 7A and 7B, by which the drum 3 (cartridge P) is precisely positioned relative to the apparatus main assembly 1A, are placed in contact. In terms of the direction perpendicular to the axial line of the drum 3, it is by the first and second bearings 7A and 7B that each cartridge P is precisely positioned relative to the apparatus main assembly 1A. Thus, as the front door 2 is closed, each cartridge P is precisely positioned relative to the apparatus main assembly 1A, more specifically, it is moved by the movement of the front door 2 into its image forming position in the apparatus main assembly 1A, and is held in the position until the front door 2 is reopened. While the cartridge P is in this position, the drum 3 of the cartridge P remains in contact with the belt 15, by the top portion of its peripheral surface, as shown in FIG. 1. The portion of the belt 15, with which the top portion of the peripheral surface of the drum 3 remains in contact, is the portion of the belt 15, which is moving through the bottom portion of the belt loop. It is also while the cartridge P is in this position that the rotational driving force can be transmitted to the cartridge P from the coupling 51, with which the apparatus main assembly 1A is provided, as shown in FIG. 19. More specifically, the apparatus main assembly 1A is provided with the coupling 51, whereas the cartridge P is provided a coupling 3*a*1, which is a part of the flange 3*a*, with which one of the lengthwise end portions of the drum 3 is fitted. As the cartridge P is moved by the supporting member 27 into the position in which the cartridge P is kept precisely positioned relative to the apparatus main assembly 1A by the first and second cartridge positioning portions 29 and 30 of the apparatus main assembly 1A, the coupling 51 of the apparatus main assembly 1A engages with the coupling 3*a*1 of the cartridge P. To describe in more detail the couplings 51 of the apparatus main assembly 1A and the coupling 3*a*1 of the cartridge P, the coupling 51 has a hole 51*a*, which is roughly triangular in cross section, whereas the coupling 3*a* has a projection, which is also roughly triangular in cross section, and which fits into the hole 51*a* of the coupling 51. Thus, the engagement between the coupling 51 and coupling 3*a*1 means that the projection 3*a*1 fits into the hole 51*a* of the coupling 51. Thus, as the coupling 51 rotates while the projection 3*a*1 of the coupling 3*a* is in the hole 51*a* of the coupling 51, the rotational driving force is transmitted to the drum 3. Further, the apparatus main assembly 1A is provided with a coupling supporting member 52, which supports the coupling 51, and the movement of which is linked to the movement of the front door 2. Thus, as the front door 2 is closed, the coupling supporting member 52 is moved in the direction indicated by an arrow mark f by the movement of the front door 2, and therefore, the projection 31*a*1 of the coupling 3*a* fits into the coupling 51 of the apparatus main assembly 1A, whereas as the front door 2 is opened, the coupling supporting member 52 is moved in the direction indicated by an arrow mark b by the movement of the front door 2, and therefore, the coupling 51 of the apparatus main assembly 1A is disengaged from the coupling 3*a* of the drum 3.

Figure 9:
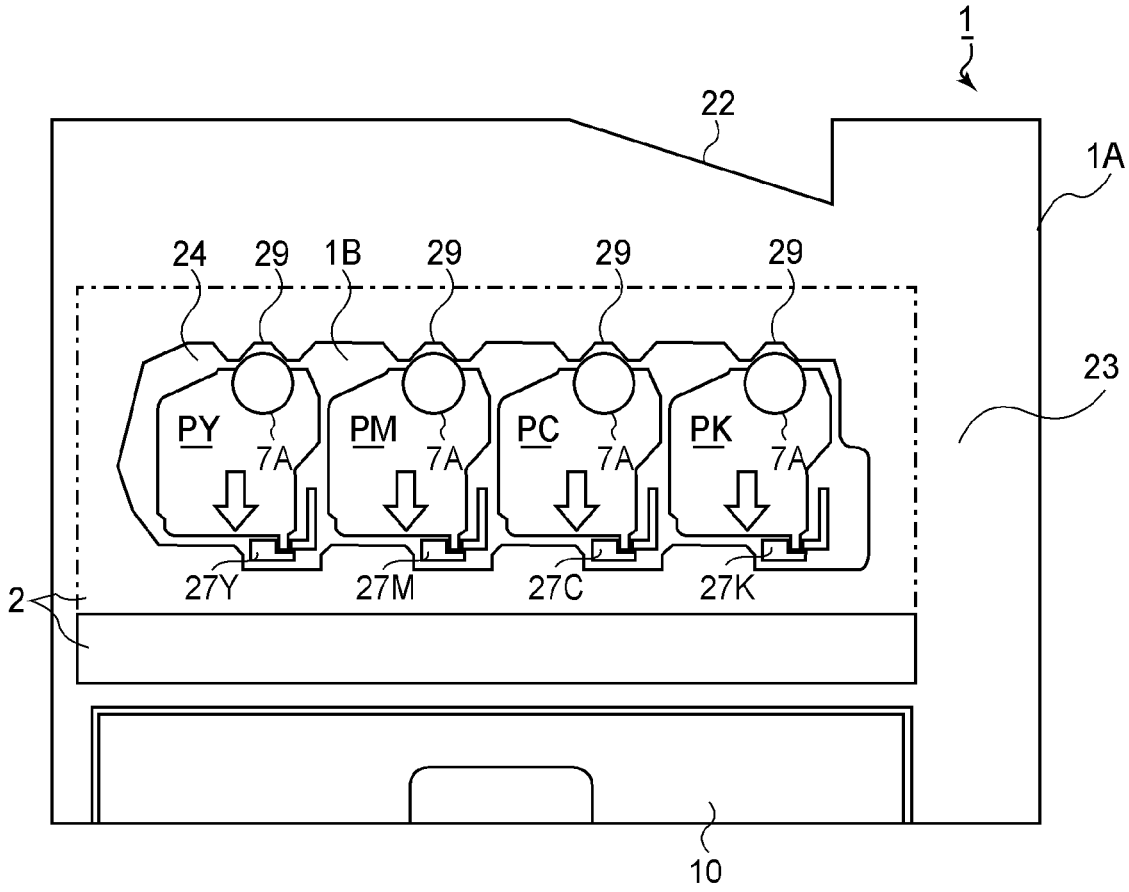
FIG. 9 is a front view of the image forming apparatus, and the four process cartridges therefor, when the cartridges are in their position into which they are moved into before they are precisely positioned relative to the apparatus main assembly, and which allows them to be dismounted from the apparatus main assembly.
Figure 10:
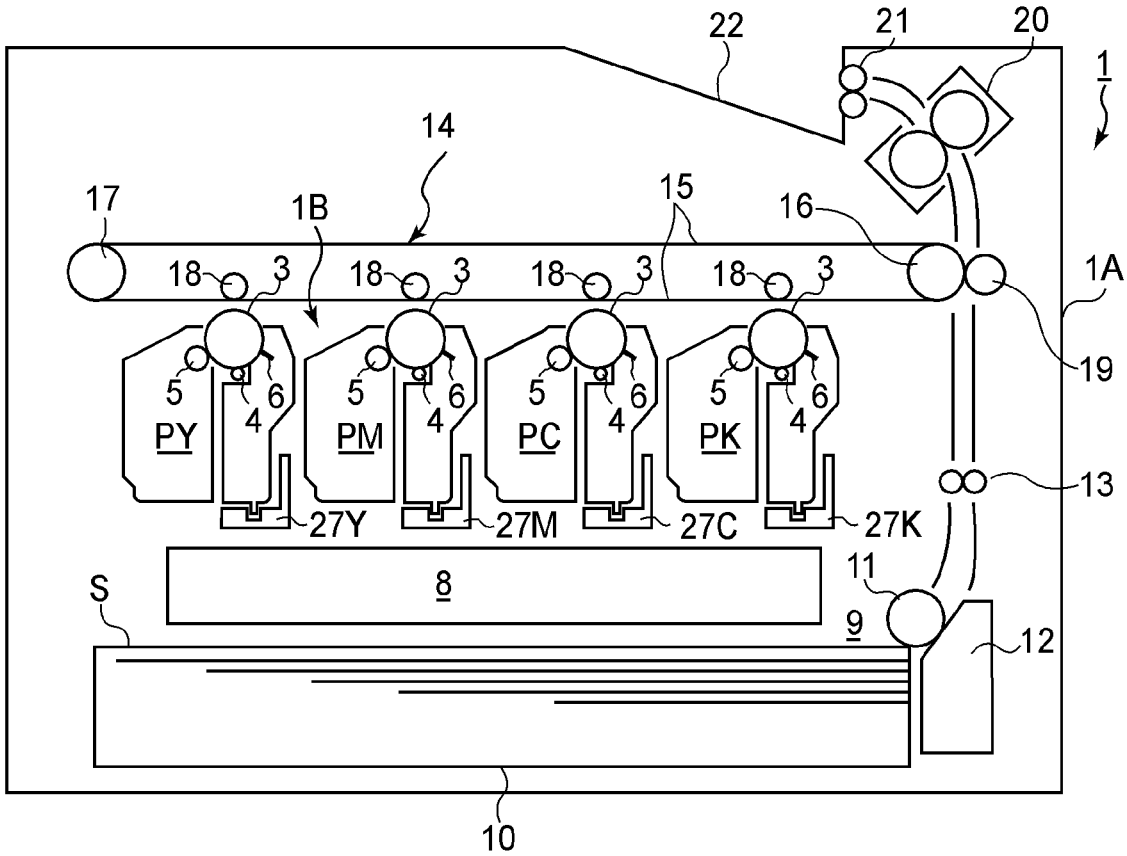
FIG. 10 is a schematic vertical sectional view of the image forming apparatus in the first preferred embodiment, at a plane parallel to the front panel of the image forming apparatus, when the four cartridges are in their intermediary positions where they are temporarily positioned before they are precisely positioned relative to the apparatus main assembly, or before they are moved out of the apparatus main assembly, and where their photosensitive drums are not in contact with the intermediary transfer belt.

FIGS. 9 and 12(*b*) depict the state of the image forming apparatus 1, in which each supporting member 27 is in the second position into which it was moved down. When the supporting member 27 in its second position, the corresponding cartridge P is kept in the position in which the top portions of the first and second bearings 7A and 7B are not kept pressed upon the first and second cartridge positioning portions 29 and 30 of the apparatus main assembly 1A; the first and second bearings 7A and 7B are not in contact with the first and second cartridge positioning portions 29 and 30 of the apparatus main assembly 1A. Thus, when the supporting member 27 is in its second position, the cartridge P is in its position into which it is moved when it is mounted into the apparatus main assembly 1A, or from which it is removed when it is removed from the apparatus main assembly 1A. Referring to FIG. 10, when the cartridge P is in this position in the apparatus main assembly 1A, into which the cartridge P is mounted, and which allows the cartridge P to be removed from the apparatus main assembly 1A, there is a space (gap) between the top portion of the peripheral surface of the drum 3 in the cartridge P and the portion of the belt 15, which corresponds in position to the bottom portion of the belt loop. Also when the cartridge P is in this position, the rotational driving force is not transmitted to the cartridge P from the apparatus main assembly 1A, nor is the cartridge P supplied with the biases by the apparatus main assembly 1A.

The operation for mounting the cartridge P into the apparatus main assembly 1A, or removing the cartridge P from the apparatus main assembly 1A is as follows: Referring to FIG. 3, first, the front door 2 is to be fully opened to expose the opening 24. As the front door 2 is rotationally opened, the each supporting member 27 is moved down by the supporting member moving mechanism into its second position (FIG. 12(*a*)→12(*b*)). By this movement of the cartridge supporting member 27, the cartridge P is moved into its position which allows the cartridge P to be moved out of the apparatus main assembly 1A, and also, into which the cartridge P is temporarily moved before it is to be precisely positioned relative to the apparatus main assembly 1A as it is mounted into the apparatus main assembly 1A. It is when the cartridge P is in this position, which corresponds to the second position of the cartridge supporting member 27, that the cartridge P can be moved out of the apparatus main assembly 1A through the opening 24, by pulling the cartridge P frontward to slide the cartridge P along the supporting member 29, which is supporting the cartridge P. As for the mounting of the cartridge P into the apparatus main assembly 1A, if a user wants to insert the cartridge P into the apparatus main assembly 1A, first, the user is to position the cartridge P so that the lengthwise end of the cartridge P, from which the cartridge P is driven, faces the apparatus main assembly 1A. Then, the user is to slide the cartridge P into the apparatus main assembly 1A along the supporting member 27 through the opening 24. The cartridge P is to be inserted deep enough into the apparatus main assembly 1A for the cartridge P to be caught by the rear panel 28 of the apparatus main assembly 1A so that the cartridge P cannot be inserted any further (FIG. 12(*c*)).

Figure 6:
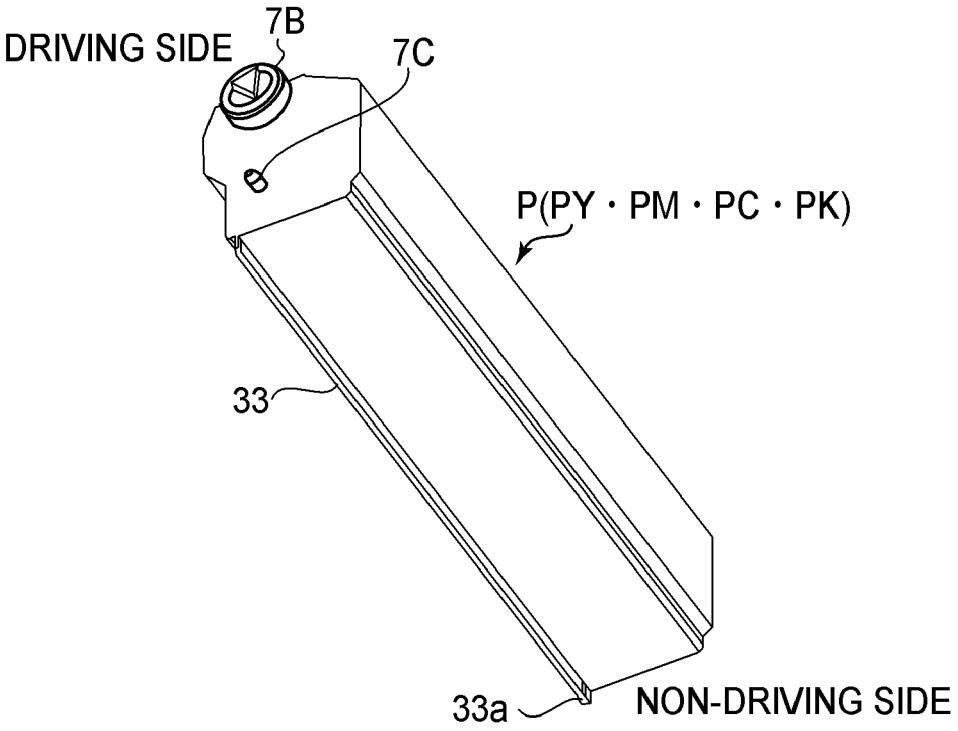
FIG. 6 is a perspective view of one of the cartridges for the image forming apparatus in the first preferred embodiment, as seen from diagonally below the lengthwise end of the cartridge, from which the cartridge is driven.
Figure 8:
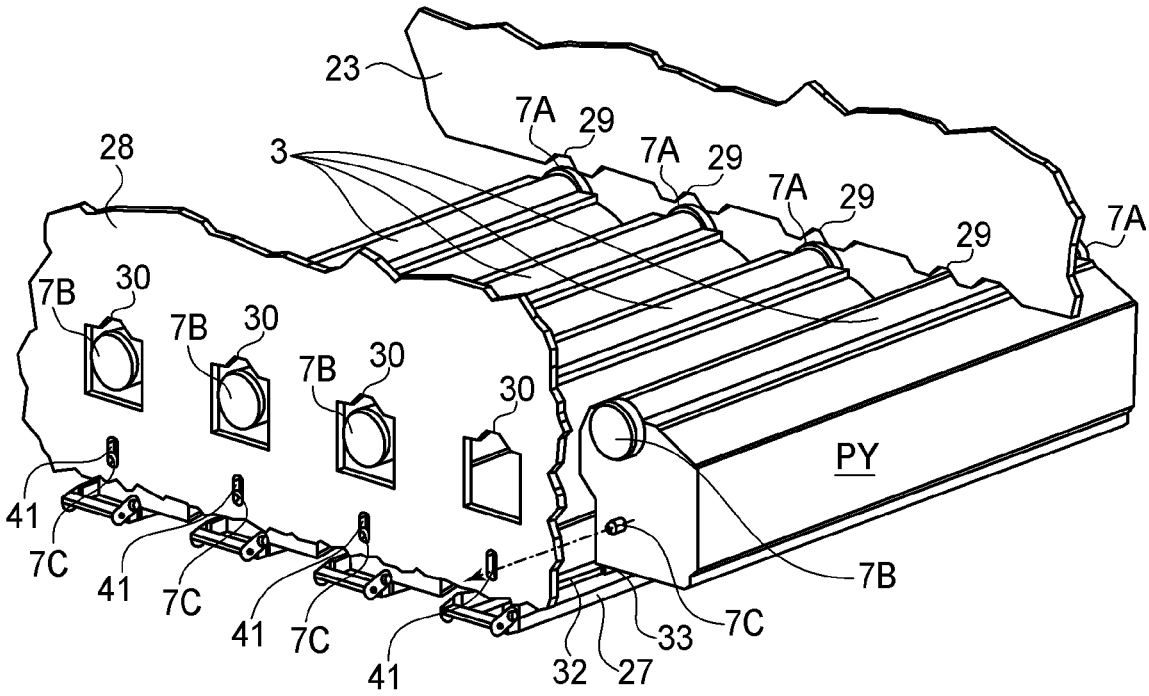
FIG. 8 is a partly broken-away perspective view of the image forming apparatus in the first preferred embodiment, and the process cartridges therefor, in which the image forming apparatus is partly broken away, and which is for describing the portions of the cartridges, by which the cartridges are precisely positioned relative to the apparatus main assembly, and the portions of the apparatus main assembly, which are for precisely positioning the drums relative to the apparatus main assembly.
Figure 13:
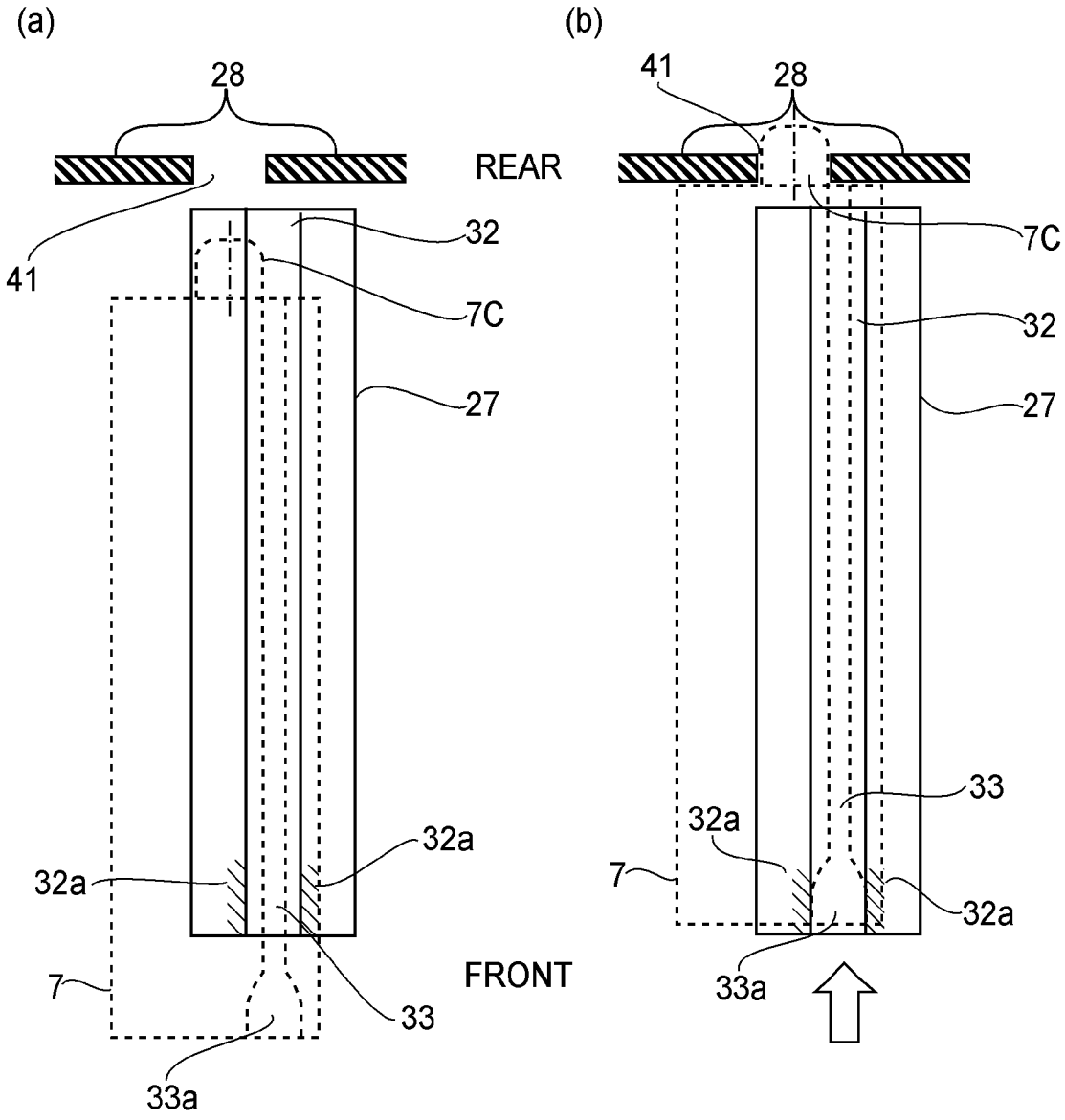
FIGS. 13(*a*) and 13(*b*) are a combination of a top view of the cartridge supporting member and a phantom top view of the cartridge thereon, in the first preferred embodiment, in the final stage of the mounting of the process cartridge, and after the mounting of (precise positioning) of the process cartridge, respectively.

FIG. 6 is a perspective view of one of the cartridges P, as seen from diagonally below the lengthwise end of the cartridge, from which the cartridge is driven. FIG. 8 is a broken-away perspective view of the image forming apparatus, and the process cartridges 7 therefor, as seen from diagonally below the rear panel of the apparatus main assembly 1A. It is for describing the state of the image forming apparatus, in which the first cartridge PY has just been pulled out halfway from the apparatus main assembly 1A, whereas the other cartridges are in their second position into which they were moved down by the downward movement of the supporting members 27. FIGS. 13(*a*) and 13(*b*) are a combination of a top view of the cartridge supporting member and a phantom top view of the cartridge thereon, in the final stage of the mounting of the process cartridge, and after the mounting of (precise positioning) of the process cartridge, respectively.

Each cartridge P is provided with a rotation stopper boss 7C, which perpendicularly protrudes from the downstream panel of the cartridge P in terms of the cartridge insertion direction. Correspondingly, the rear panel 28 of the apparatus main assembly 1A is provided with four elongated holes 41, which match in position to the four cartridges P, one for one, and the long axis of which is parallel to the direction in which the supporting members 27 are moved up or down. As each cartridge P is inserted into the apparatus main assembly 1A as far as possible, the rotation stopper boss 7C of the cartridge P fits into the corresponding elongated hole 41 of the rear panel 28 (FIG. 13(*a*)→FIG. 13(*b*)). Then, each supporting member 27 is moved up into its first position, whereby the drum 3 of the cartridge P is precisely positioned relative to the apparatus main assembly 1A by the drum bearing positioning portions 29 and 30. When the drum 3 remains precisely positioned by the drum bearing positioning portions 29 and 30, the rotation stopper boss 7C is in the corresponding elongated hole 41 of the rear panel 28. Thus, the rotation stopper boss 7C and elongated hole 41 prevent the lengthwise end portion of the cartridge P, which corresponds to the rear portion of the apparatus main assembly 1A, from rotationally moving relative to the apparatus main assembly 1A.

Referring to FIG. 5, the top surface of each supporting member 27 is provided with a groove 32 (guiding portion) which extends in the lengthwise direction of the supporting member 27, that is, the direction parallel to the direction in which the cartridge P is mounted into, or removed from, the apparatus main assembly 1A. Next, referring to FIG. 6, the bottom wall of the cartridge P is provided with a rib 33, which extends in the lengthwise direction of the cartridge P. The rib 33 protrudes perpendicular to the bottom wall of the cartridge P, and is positioned so that when the cartridge P is mounted into, or removed from the apparatus main assembly 1A, it can be fitted into the abovementioned groove 32 of the supporting member 27 of the apparatus main assembly 1A to prevent the cartridge P from moving in the direction other than the direction in which the cartridge P is moved into, or removed from, the apparatus main assembly 1A. Thus, the width of the rib 33, that is, the dimension of the rib 33 in terms of the direction perpendicular to the lengthwise direction of the groove 32, is made less than the width of the groove 32, providing thereby a proper amount (1 mm-3 mm) of play (gap) between the rib 33 and the walls of the groove 32 to make it easier for the cartridge P (rib 33) to be mounted into, or removed from, the apparatus main assembly 1A, across most of the moving range of the cartridge P in the rear portion of the apparatus main assembly 1A. However, a portion 33*a* of the rib 33, which will be at the front end of the apparatus main assembly 1A after the mounting of the apparatus main assembly 1A (upstream end portion in terms of cartridge mounting direction), is formed wide enough to provide virtually no play (gap) between the rib 33 and the walls of the groove 32. Therefore, as the supporting member 27 is moved up into its first position as shown in FIG. 12, the drum 3 of the cartridge P is precisely positioned relative to the apparatus main assembly 1A by the drum bearing positioning portions 29 and 30. Further, the engagement between the portion 33*a* of the rib 33 and the front portion 32*a* of the groove 32, which are shown in FIG. 13, prevents the portion of the cartridge P, which is on the front side of the apparatus main assembly 1 after the mounting of the cartridge P, from rotationally moving relative to the apparatus main assembly 1A. To describe in more detail, as the process cartridge P receives the rotational driving force from the apparatus main assembly 1A, that is, as the coupling 3*a* of the drum 3 receives the driving force from the coupling 51 of the apparatus main assembly 1A, the process cartridge P is subjected to such a force that works in the direction to press the process cartridge P upon the drum bearing positioning portions 29 and 30. This force is caught by the contact between the portion 33*a* of the rib 33, or the third cartridge positioning portion of the cartridge P, and the portion 32*a* of the groove 32, or the third cartridge positioning portion of the apparatus main assembly 1A. Therefore, even when the rotational driving force is transmitted from the apparatus main assembly 1A to the process cartridge P, the process cartridge P remains stable in attitude. That is, the third drum positioning portion 33*a* of the process cartridge P, which is the farthest portion of the process cartridge P from the drum coupling 3*a*, and is in the diagonal direction from the drum coupling 3*a*, is precisely positioned relative to the apparatus main assembly 1A by the third cartridge positioning portion 32*a* of the groove 32. Thus, the problem that as the process cartridge P is subjected to the rotational driving force transmitted to the drum 3, it is twisted by the force, can be prevented. Therefore, the process cartridge P remains highly precisely positioned relative to the apparatus main assembly 1A. Further, the third cartridge positioning portion 32*a* is provided as a part of the groove 32 of the supporting member 27, which is for guiding the process cartridge P when the process cartridge P is mounted into, or removed from, the apparatus main assembly 1A. In other words, the image forming apparatus and the cartridges therefor in this embodiment are very simple in structure, and yet, can highly precisely position the process cartridges P relative to the apparatus main assembly 1A.

Further, referring again to FIG. 13, the process cartridge P is provided with the rotation stopper 7C, as the fourth cartridge positioning portion of the process cartridge P, which perpendicularly projects outward from the downstream end of the external frame 7 of the cartridge P in terms of the cartridge mounting direction. Thus, as the process cartridge P is mounted into the apparatus main assembly 1A, this rotation stopper 7C fits into the elongated hole 41 of the apparatus main assembly 1A, that is, the fourth cartridge positioning portion of the apparatus main assembly 1A. Therefore, as the process cartridge P is mounted into the apparatus main assembly 1A, not only is the front side (upstream side in terms of cartridge mounting direction) of the process cartridge P prevented from rotationally moving, by the contact between the third cartridge positioning portion 33*a* of the process cartridge P and the third cartridge positioning portion 32*a* of the groove 32 of the apparatus main assembly 1A, but also, the rear side (downstream side in terms of cartridge mounting direction) of the process cartridge P is prevented from rotationally moving, by the contact between the rotation stopper 7C, that is, the fourth cartridge positioning portion of the process cartridge P, and the wall of the elongated hole 41 of the apparatus main assembly 1A. Therefore, the process cartridge P is precisely positioned in terms of its attitude relative to the apparatus main assembly 1A. Incidentally, the elongated hole 41, into which the rotation stopper 7C fits, is elongated in such a direction that allows the process cartridge P to be moved by the supporting member 27.

As described above, each supporting member 27 plays the role of a guiding member for preventing the problem that when the cartridge P is mounted into, or removed from, the apparatus main assembly 1A, it moves in the direction other than the direction in which it is mounted or removed. Further, as the cartridge P is inserted into the apparatus main assembly 1A, each supporting member 27 supports the cartridge P from underneath, and pushes the cartridge P upward to place the cartridge positioning portions 7A and 7B, that is, the drum supporting bearings 7A and 7B, in contact with the cartridge positioning (drum positioning) portions 29 and 30 of the apparatus main assembly 1A. Further, the groove 32 of the supporting member 27 and the rib 33 of the cartridge P are structured so that when the cartridge P is completely in the apparatus main assembly 1A, there is virtually no gap between the portion 33*a* of the rib 33 of the cartridge P, which will be at the front of the apparatus main assembly 1A after the proper mounting of the cartridge P into the apparatus main assembly 1A, and the wall of the front portion 32*a* of the groove 32 of the supporting member 27. Thus, when the cartridge P is completely in the apparatus main assembly 1A, the engagement between the groove 32 of the supporting member 27, and the upstream end portion 33*a* of the rib 33 of the cartridge P and groove 32 prevent the lengthwise end portion (in terms of cartridge mounting direction) of the cartridge P, makes up the means for preventing the upstream end portion of the cartridge P, from rotationally moving relative to the apparatus main assembly 1A; they play the role of keeping the cartridge P precisely positioned in its image forming position in the apparatus main assembly 1A.

<Supporting Member Moving Mechanism>

Next, the supporting member moving mechanism, that is, the mechanism for moving the supporting members 27 upward or downward, and the linkage between the supporting member moving mechanism and front door 2, will be described.

Figure 11:
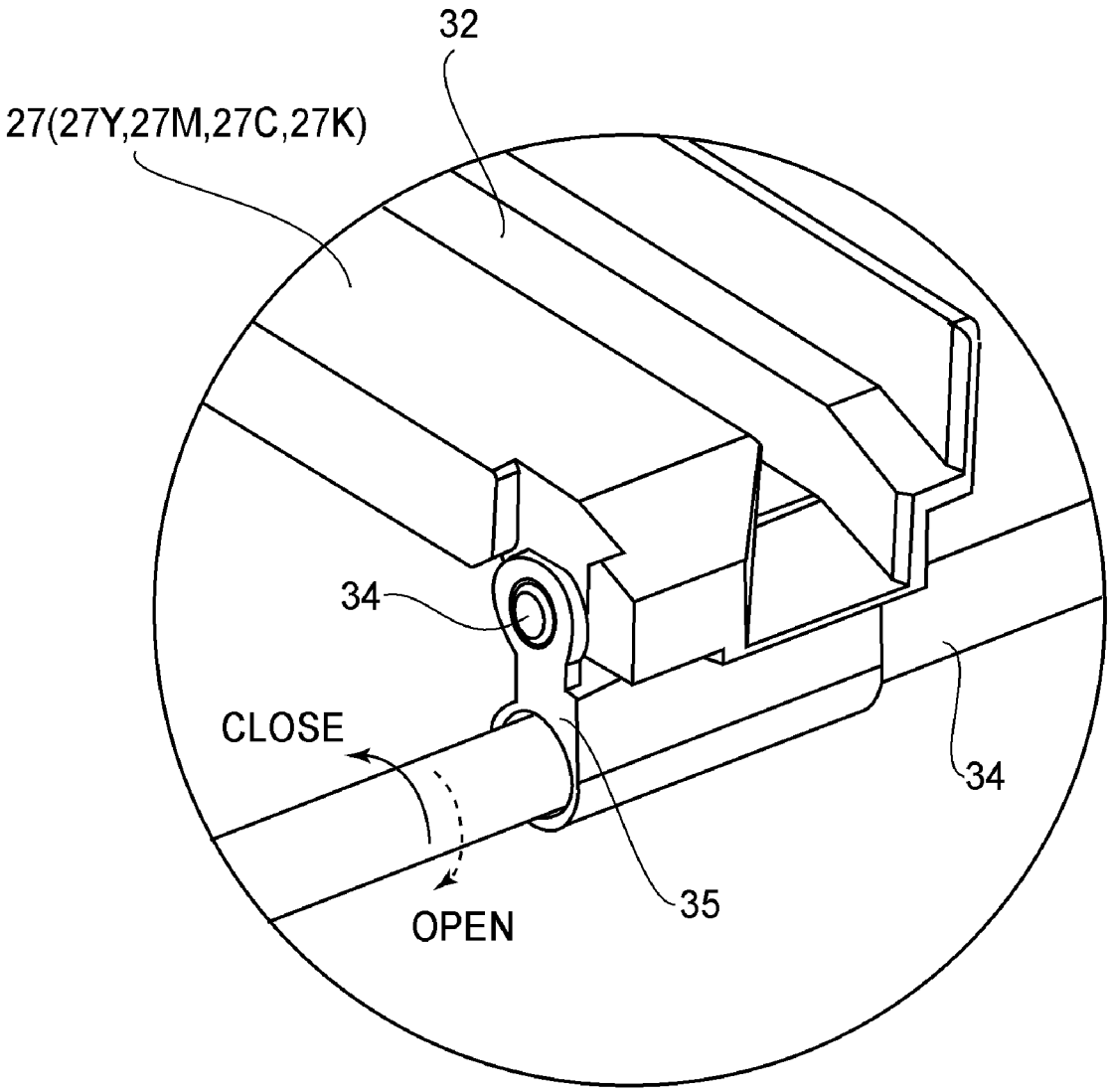
FIG. 11 is an enlarged perspective view of one of the arms and its adjacencies.

Referring to FIG. 3, the first to fourth supporting members 27 (27Y, 27M, 27C, and 27K) are connected to each other by their front end to a single (common) supporting member linking shaft 34 (second rotational shaft, which hereafter may be referred to simply as linking shaft); the front end of each supporting member 27 is connected to the linking shaft 34). The linking shaft 34 is disposed so that its axial line C-C is horizontal, that is, perpendicular to the direction in which the cartridges P are moved upward or downward. The linking shaft 34 is rotatably supported by the pair of bearings 26, with which the front panel 23 of the apparatus main assembly 1A is provided. Next, referring to FIG. 12, the front end portion of each supporting member 27 and the linking shaft 34 are connected to each other by a first arm 35, which rotates with the linking shaft 34. More specifically, the front end portion of the supporting member 27 and the arm 35 are connected to each other with a connective shaft 36 in such a manner that the supporting member 27 is allowed to rotationally move about the shaft 36. FIG. 11 is an enlarged view of one of the arms 35, and its adjacencies. Referring to FIGS. 5, 11, and 12, the rear end portion of the supporting member 27 is connected to the apparatus main assembly 1 with a link 37. Designated by a reference number 38 is a connective shaft which connects the link 37 to the apparatus main assembly 1A. Designated by a reference number 39 is a connective shaft which connects link 37 to the rear end portion of the supporting member 27. The distance between the axial line of the shaft 34 of the arm 35 and the axial line of the shaft 36 of the arm 35 is the same as the distance between the axial line of the shaft 38 of the link 37 and the axial line of the shaft 39 of the link 37.

That is, the supporting member 27, the connective shaft 34, the arm 35, the link 37, the shafts 38, and the shaft 39 form a parallelepipedic linkage. Thus, as the linking shaft 34 is rotated, each supporting member 27 diagonally moves while remaining horizontal. More concretely, as the linking shaft 34 is rotated in the direction to cause the arm 35 to stand upright, the supporting member 27 is moved up into its first position where it holds the cartridge P in the image forming position in the apparatus main assembly 1A, as shown in FIG. 12(*a*). Further, referring to FIG. 12(*b*), as the linking shaft 34 is rotated in the direction to cause the arm 35 to fall frontward of the apparatus main assembly 1A, the supporting member 27 is moved down into its second position where it holds the cartridge P in the position which allows the cartridge P to be removed from the apparatus main assembly 1A. Incidentally, the linking shaft 34 moves all the supporting members 27 together.

The above-described downward and upward movement of the first to fourth supporting members 27, which is caused by the supporting member moving mechanism, is linked to (and caused by) the opening and closing of the front door 2, respectively.

That is, referring to FIG. 5, the right end of the linking shaft 34 is provided with a linking arm 40 (second arm), which extends roughly perpendicular to the shaft 34. The linking arm 40 is solidly attached to the shaft 34 so that it rotates with the shaft 34. Further, the opposite end of the linking arm 40 from the linking shaft 34 is provided with a pin 40*a*, which protrudes parallel to the linking shaft 34. The pin 40*a* is engaged with the front door 2 in such a manner that it is guided by the groove of a linking arm pin guiding member 42, which is attached to the inward surface of the front door 2.

Thus, as the front door 2, which is open, is closed, it rotates about the shaft 25, causing thereby the pin 40*a* protruding from the opposite end of the linking arm 40 from the shaft 26, to move along the groove of the linking arm pin guiding member 42. As a result, the linking shaft 34, to which the linking arm 40 is solidly attached, is rotated in the direction to move the supporting member 27 upward. On the other hand, as the front door, which is closed, is opened, the pin 40*a* is moved along the groove of the linking arm pin guiding member 42, causing the linking shaft 34, to which the linking arm 40 is solidly attached, to rotate in the direction to cause the supporting member 27 to move downward.

As described above, in this embodiment, the problem that when the process cartridge P is in its image forming position in the apparatus main assembly 1A, the portion of the process cartridge P, which is on the front side of the apparatus main assembly 1A, rotationally moves, is prevented by structuring the main assembly of the image forming apparatus and the process cartridges therefor so that the portion 33*a* of the rib 33 of each process cartridge tightly fits in the portion 32*a* groove 32 of the corresponding vertically movable cartridge supporting member 27. Thus, not only is the cartridge positioning structural arrangement in this embodiment superior to conventional cartridge positioning structural arrangement, for example, the one that uses a large component, such as the front door, to precisely position multiple process cartridges relative to the apparatus main assembly, but also, it makes it possible to make the front door of resinous components, being therefore advantageous in terms of cost to the conventional cartridge positioning structural arrangement. Further, the cartridge positioning structural arrangement in this embodiment is such that the cartridge rotation preventing means moves with the process cartridge(s) as the process cartridge(s) are moved upward or downward. Therefore, the cartridge rotation preventing means does not interfere with the operation (mechanism) for moving the process cartridge (s) upward or downward, making the image forming apparatus in this embodiment more reliable than the image forming apparatuses employing the conventional cartridge positioning structural arrangement. Further, the cartridge rotation preventing means in this embodiment is engaged at the last moment of the push applied to the process cartridge to mount the process cartridge into the main assembly of the image forming apparatus. Thus, the cartridge positioning structural arrangement in this embodiment does not reduce the image forming apparatus in operability.

Generally speaking, in consideration of the possibility that as the driving force is transmitted to the drum in a process cartridge, the process cartridge may be twisted by the driving force, a means for preventing a process cartridge from rotationally moving is designed so that only one of the lengthwise end portion of the process cartridge is used to precisely position the process cartridge relative to the main assembly of an image forming apparatus, whereas a small play (gap) is provided between the lengthwise end of the process cartridge and the apparatus main assembly. In comparison, in the case of the cartridge positioning structural arrangement in this embodiment, the tight engagement between the groove 32 of the supporting member 27, and the front end portion 33*a* (trailing end portion in terms of cartridge insertion direction) of the rib 33 of the process cartridge, is utilized as the cartridge positioning means, whereas a slight play (gap) is provided between the rotation control boss 7C of the process cartridge, and the elongated hole 41 of the rear panel of the apparatus main assembly, in order to prevent the cartridge rotation preventing means on the rear side from interfering with the upward or downward movement of the supporting member 27 (cartridge).

Therefore, it is ensured that while the image forming apparatus performs an image forming operation, the external frame 7 (shell) of the cartridge P, and the processing means, that is, the charging means 4, the developing means 5, and the cleaning means 6, which are in the external frame 7, remain precisely aligned relative to the drum 3, making it possible for the image forming apparatus to continuously output images of excellent quality.

Embodiment 2

The image forming apparatus in the second preferred embodiment of the present invention is similarly structured to the image forming apparatus in the first preferred embodiment, except that its cartridge rotation preventing means on the downstream end of each cartridge P is the same as that on the upstream end. That is, it is made up of the groove with which the cartridge supporting member is provided, and the rib which is protruding from the cartridge P.

Figure 14:
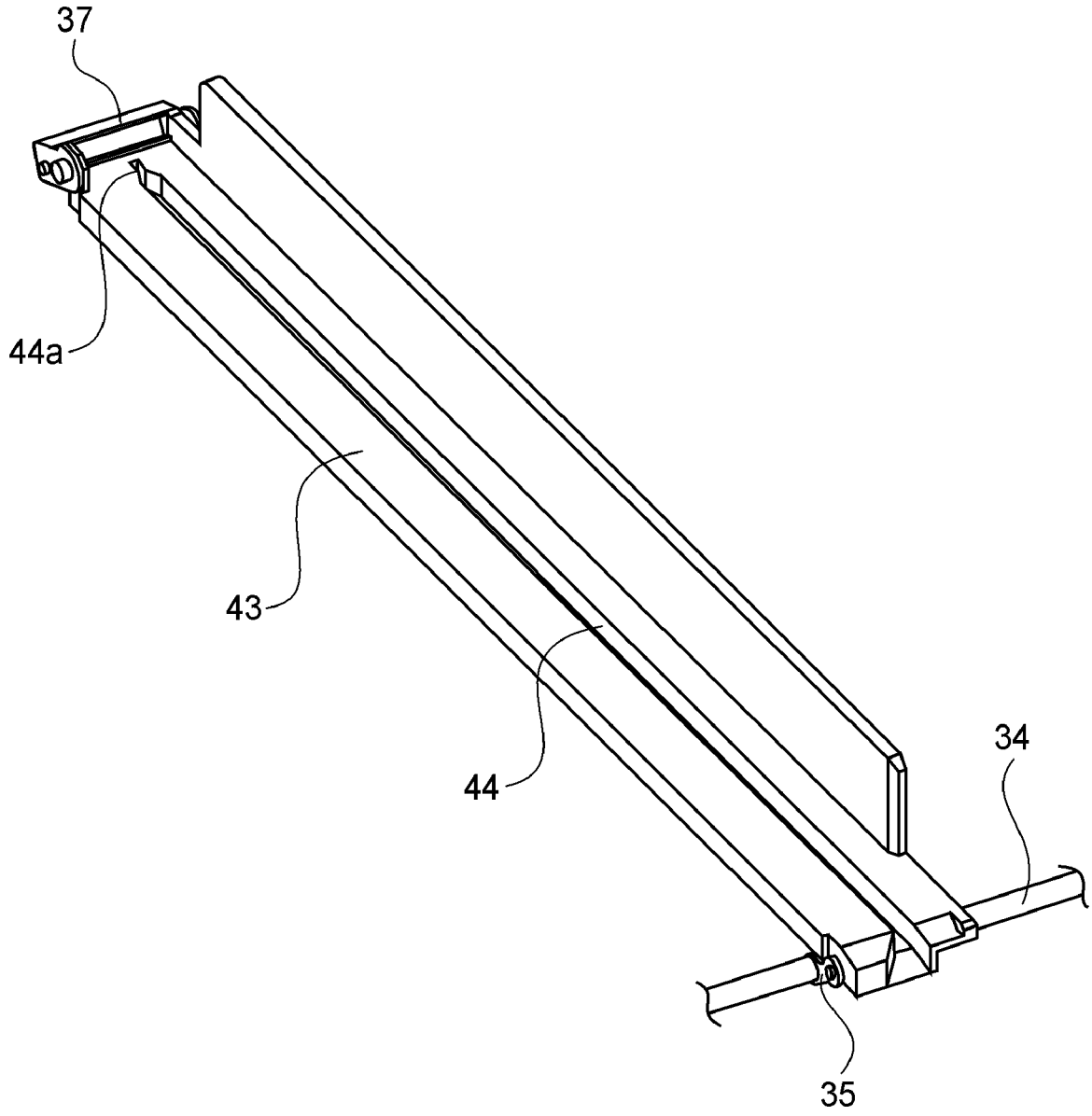
FIG. 14 is a perspective view of one of the cartridge supporting members in the second preferred embodiment of the present invention.
Figure 15:
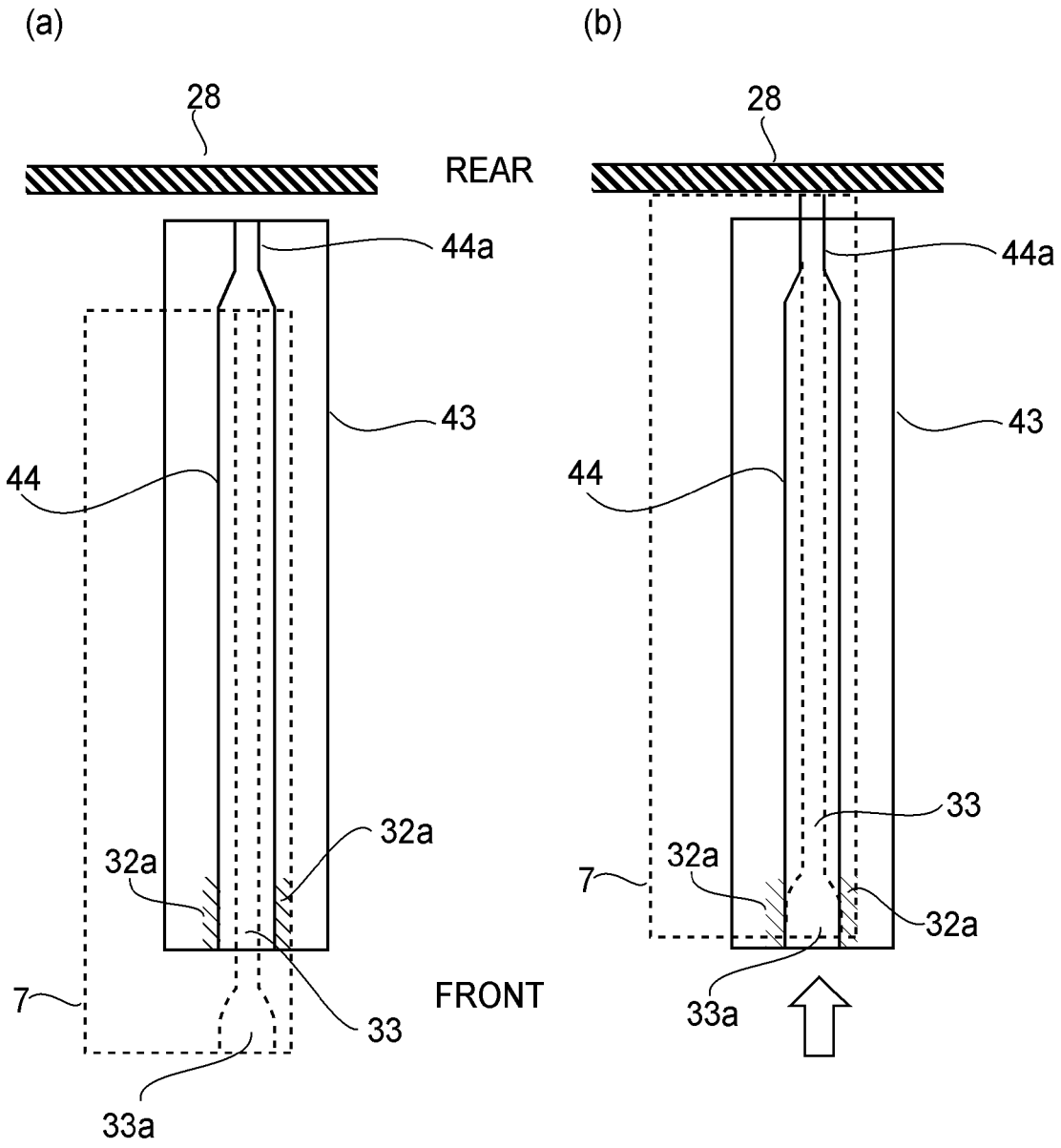
FIGS. 15(*a*) and 15(*b*) are a combination of a top view of the cartridge supporting member and a phantom top view of the cartridge thereon, in the second preferred embodiment, in the final stage of the mounting of the process cartridge, and after the mounting of (precise positioning) of the process cartridge, respectively.

FIG. 14 is a perspective view of one of the cartridge supporting members 43 in the second preferred embodiment of the present invention. FIGS. 15(*a*) and 15(*b*) are a combination of a top view of the cartridge supporting member and a phantom top view of the cartridge thereon, in the second preferred embodiment, in the final stage of the mounting of the process cartridge, and after the mounting of (precise positioning) of the process cartridge, respectively. FIGS. 15(*a*) and 15(*b*) show what occur toward the end of the mounting of the cartridge P into the apparatus main assembly.

Each cartridge supporting member 43 in this embodiment is equivalent to each cartridge supporting member 27 in the first preferred embodiment. It is provided with a groove 44, which matches in position to the rib 33 which protrudes from the corresponding cartridge P, as is the supporting member 27. The rear end portion 44*a* of the groove 44 is narrower than rest of the groove 44, and is just wide enough for the rib 33 to fit with virtually no play (gap). The cartridge positioning (rotational movement preventing) means on the front end of the apparatus main assembly is the same as that in the first embodiment; the portion 33*a* of the rib 33 fits into the groove 44 with virtually no play (gap). It should be noted here, regarding the cartridge positioning means in this embodiment, that unlike the process cartridge in the first preferred embodiment, the process cartridge in this embodiment is not provided with the rotational movement preventing boss 7C which protrudes from the downstream (in terms of cartridge mounting direction) wall of the process cartridge, and also, that unlike the rear panel 28 of the apparatus main assembly in the first embodiment, the rear panel 28 of the apparatus main assembly in this embodiment is not provided with the elongated holes 41, which match in position the bosses 7C, one for one.

In this embodiment, both the means for preventing the downstream end portion of the cartridge P (external frame 7) from rotationally moving, and the means for preventing the upstream end portion of the cartridge P (external frame 7) from rotationally moving are made up of the rib 33 of the cartridge P and the groove 44 of the supporting member 43. Thus, there are no portions of the cartridge P which rub against the apparatus main assembly 1A when the supporting member 43 is moved upward or downward, and the engagement between the rib 33 and groove 44 does not interfere at all with the upward or downward movement of the supporting member 43 (and cartridge P thereon). Further, since the rear panel 28 of the apparatus main assembly does not need to be provided with the elongated holes 41, more spatial latitude is afforded. That is, in this embodiment, the fourth cartridge (drum) positioning portion of the apparatus main assembly is a part of the supporting member 43, and the fourth cartridge (drum) positioning portion of the cartridge P, which engages with the fourth cartridge (drum) positioning portion of the apparatus main assembly, is the end portion (downstream end portion in terms of cartridge mounting direction) of the rib 33 which is on the bottom surface of the cartridge P. Further, the play (gap) between the third cartridge positioning portion 33*a* of the cartridge P and the third cartridge positioning portion of the 32*a* of the apparatus main assembly 1A (supporting member 43) is smaller than that between the fourth cartridge positioning portion of the apparatus main assembly 1A, and the fourth cartridge positioning portion of the cartridge P, which fits into the fourth cartridge positioning portion of the apparatus main assembly 1A (supporting member 43). Otherwise, the cartridge positioning structural arrangement (cartridge rotation preventing structural arrangement) in this embodiment is the same as that in the first preferred embodiment, and further, its effects are the same as those in the first preferred embodiment.

Embodiment 3

The image forming apparatus in the third preferred embodiment of the present invention is similar to the image forming apparatus in the first preferred embodiment of the present invention described above, except that the image forming apparatus in this embodiment is opposite from that in the first embodiment in the positional relationship between the rib and groove, which controls the mounting and removal of the cartridge P. That is, in this embodiment, each cartridge P is provided with the cartridge guiding groove, and the corresponding cartridge supporting member is provided with a cartridge guiding rib, which is positioned so that it protrudes toward the cartridge supporting member when the cartridge is in the apparatus main assembly.

Figure 16:
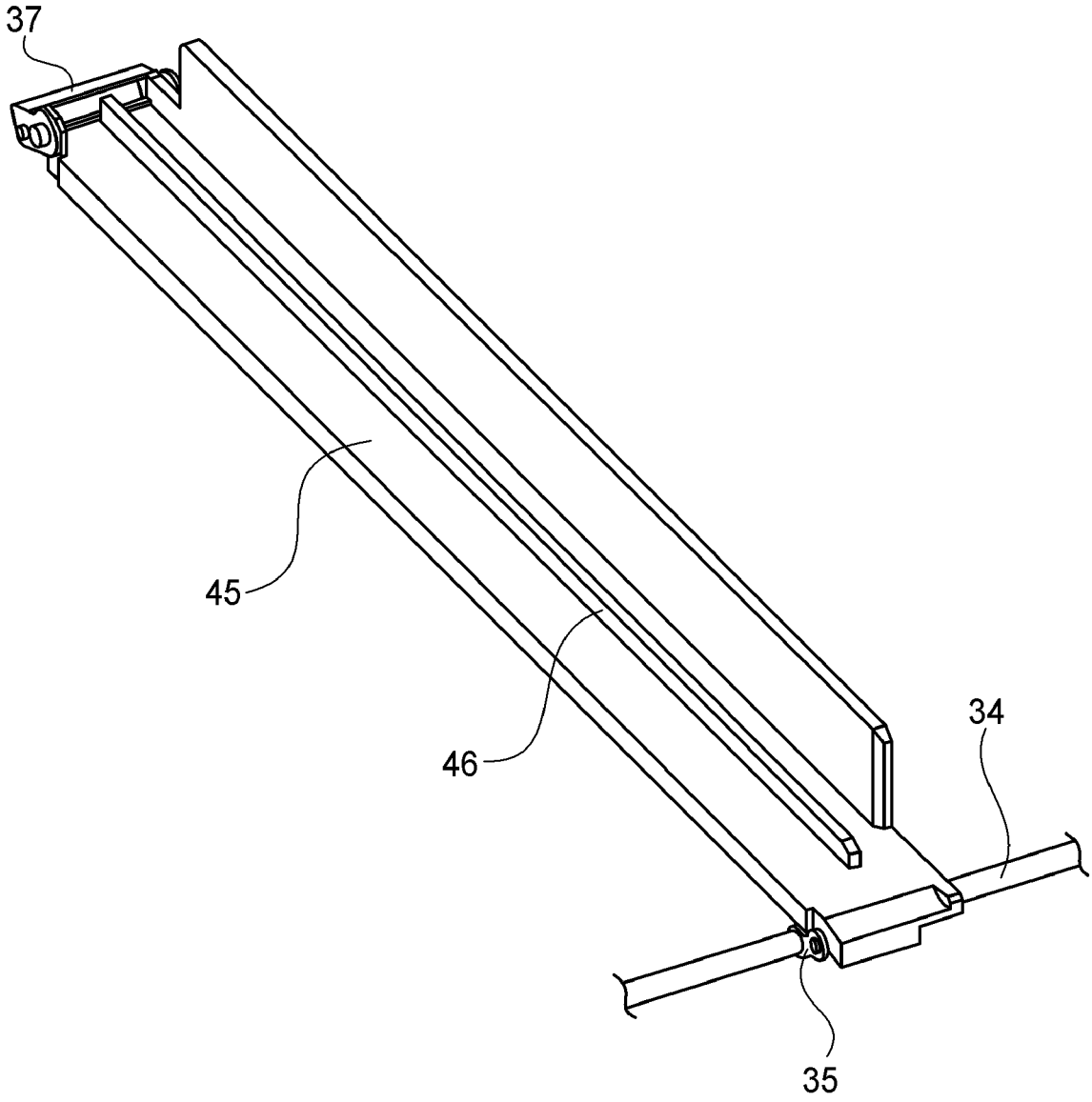
FIG. 16 is a perspective view of one of the cartridge supporting members in the third preferred embodiment of the present invention.
Figure 17:
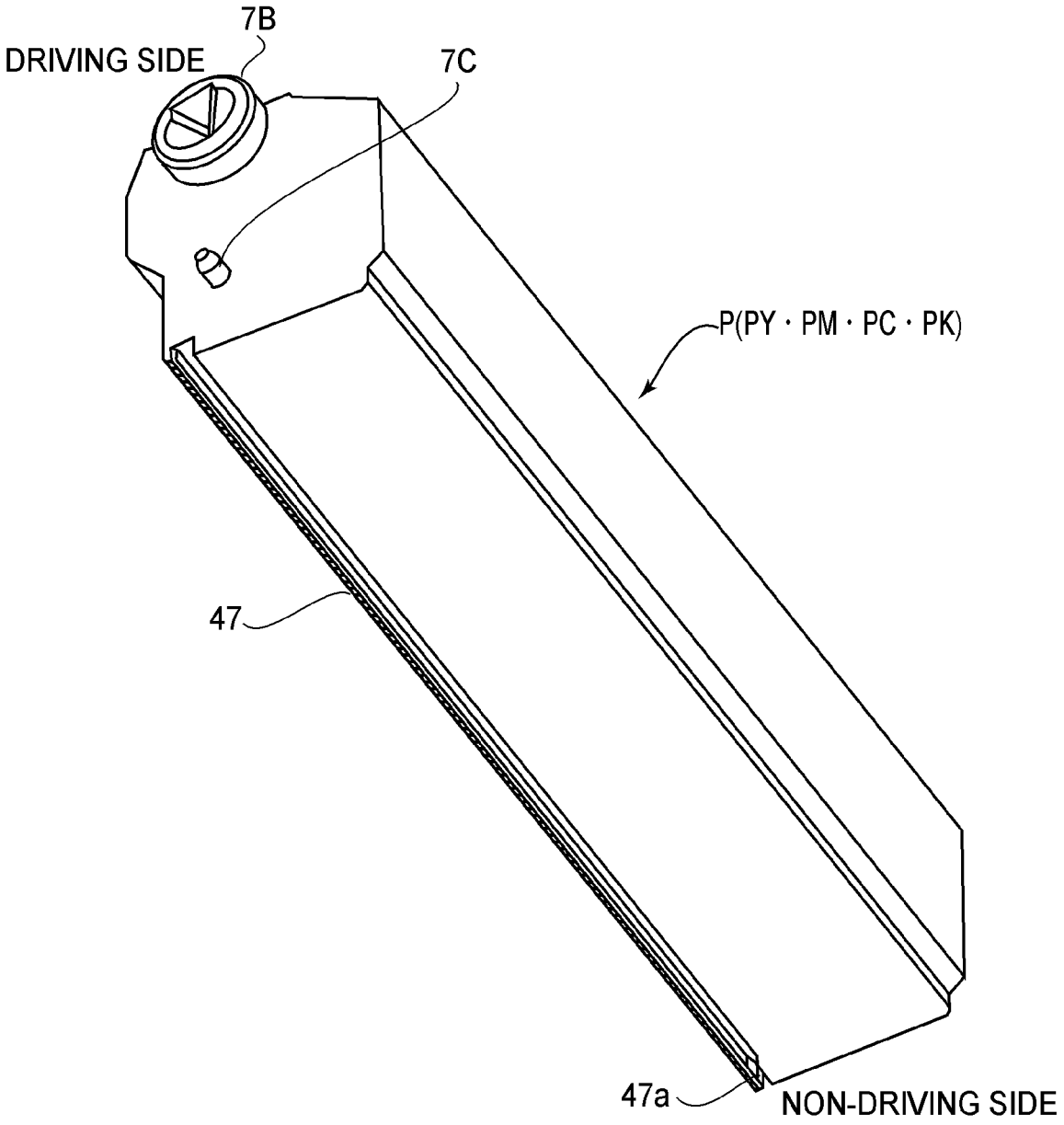
FIG. 17 is an external perspective view of one of the cartridges for the image forming apparatus in the third preferred embodiment, as seen from diagonally below the lengthwise end of the cartridge, from which the cartridge is driven.
Figure 18:
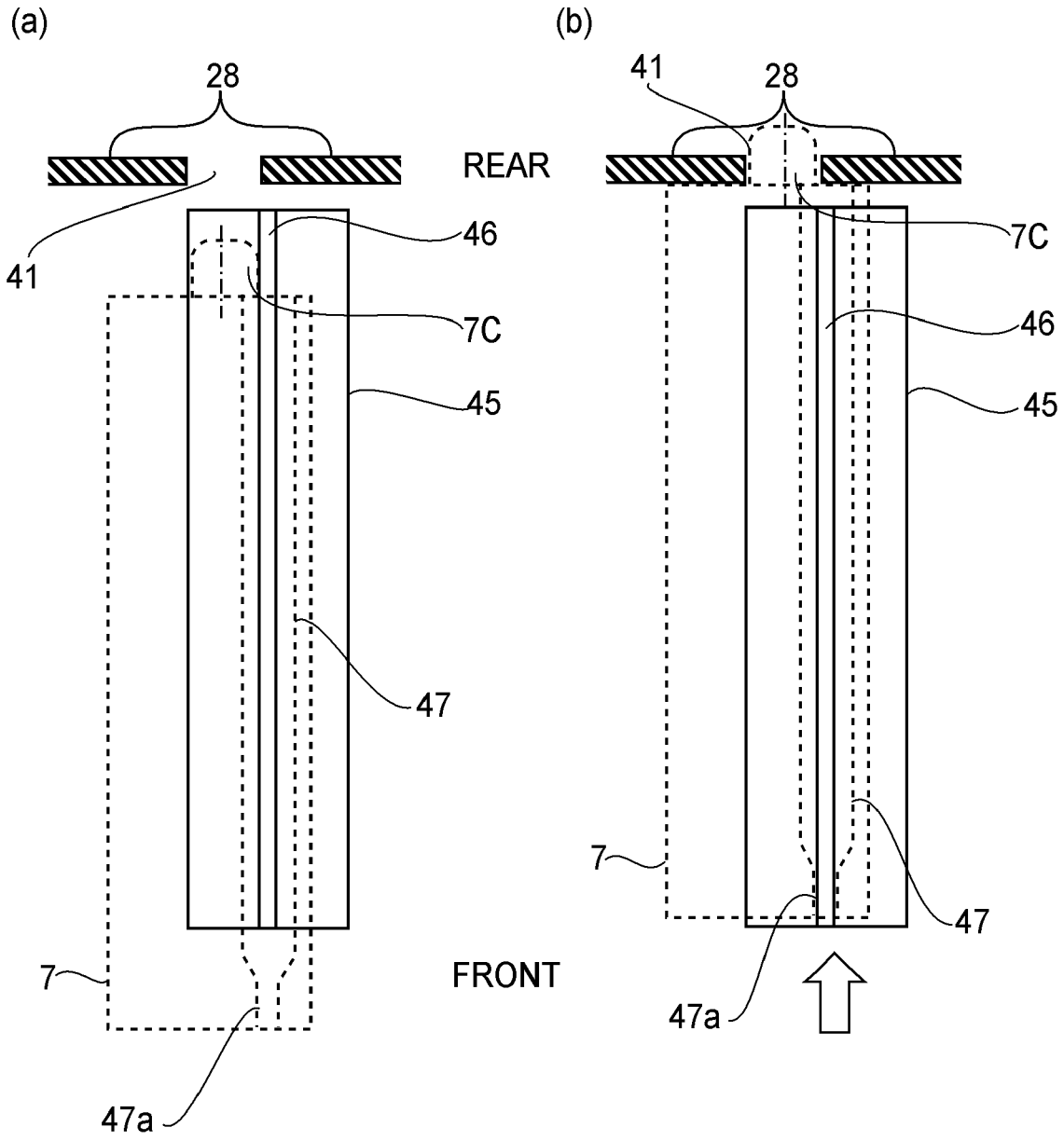
FIGS. 18(*a*) and 18(*b*) are a combination of a top view of the cartridge supporting member and a phantom top view of the cartridge thereon, in the third preferred embodiment, in the final stage of the mounting of the process cartridge, and after the mounting of (precise positioning) of the process cartridge, respectively.

FIG. 16 is a perspective view of one of the cartridge supporting members in the third preferred embodiment of the present invention. FIG. 17 is an external perspective view of one of the cartridges for the image forming apparatus in this embodiment, as seen from diagonally below the lengthwise end of the cartridge, from which the cartridge is driven. FIG. 18 is a schematic sectional view of one of the cartridge supporting members in this embodiment, at the plane coinciding with the top surface of the supporting member, when the supporting member is in the second position into which it was lowered. It shows what occurs to the relationship between the cartridge positioning means of the cartridge and the cartridge positioning means of the apparatus main assembly 1A, toward the end of the mounting of the cartridge into the apparatus main assembly 1A.

Each of the cartridge supporting members 45 in this embodiment is equivalent to the cartridge supporting members 27 in the first embodiment. Unlike the cartridge supporting member 27 in the first embodiment, the cartridge supporting member 45 in this embodiment is provided with a cartridge movement controlling rib 46 instead of the cartridge movement controlling groove. The rib 46 extends in the lengthwise direction of the cartridge supporting member, and is positioned on the surface of the supporting member, which faces upward when the cartridge is properly positioned in the apparatus main assembly 1A. Further, each of the cartridges P in this embodiment is provided with a cartridge guiding groove 47 instead of the cartridge guiding rib 33 in the first embodiment. The cartridge guiding groove 47 is positioned so that when the cartridge P is properly positioned in the apparatus main assembly 1A, the cartridge guiding groove 47 opposes the cartridge movement controlling rib 46. The guiding groove 47, except for the downstream end portion 47*a* (in terms of cartridge mounting direction), is given such a width that is wide enough to provide a proper amount of play (gap) (roughly 1-3 mm) for allowing the cartridge P to be smoothly mounted or removed. The downstream end 47*a* of the groove 47 is made narrower than the rest so that when the downstream end portion of the rib 46 is in the downstream end 47*a* of the guiding groove 47, there is virtually no play (gap) between the rib 46 and the wall of the downstream end 47*a* of the guiding groove 47, so that the engagement between the rib 46 and the downstream end 47*a* of the guiding groove 47 makes up the means for preventing the downstream end portion of the cartridge P from rotationally moving.

In the case of the image forming apparatuses in the preferred embodiments of the present invention described above, the image bearing member was an electrophotographic photosensitive member. However, the present invention is also compatible with an image forming apparatus, the image bearing member of which is an electrostatically recordable dielectric member or a magnetically recordable magnetic member.

Further, the present invention is also compatible with an image forming apparatus which employs a recording medium conveying belt (instead of the intermediary transfer belt) for conveying a sheet S of recording medium, so that the toner images formed on the image bearing members in the cartridges, one for one, are sequentially transferred in layers onto the sheet S of recording medium.

As described above, according to the present invention, it is possible to provide an image forming apparatus which is structured so that a process cartridge is removably mountable in the main assembly of the image forming apparatus in the direction parallel to the axial line of the photosensitive drum in the cartridge, and which is characterized in that it is simple in structure, and yet, can highly precisely position, and keep highly precisely positioned, the process cartridge relative to the main assembly of the image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 135684/2008 filed May 23, 2008 which is hereby incorporated by reference.

What is claimed is:

1. An image forming apparatus for forming an image on a recording material, wherein a process cartridge including a photosensitive drum and process device actable on the photosensitive drum is detachably mountable to a main assembly of said image forming apparatus in a direction of an axis of the photosensitive drum, said image forming apparatus comprising:

a first positioning portion;

a second positioning portion;

a main assembly coupling; and a supporting member, wherein said first positioning portion is provided above the process cartridge when the process cartridge is mounted to said main assembly, wherein said first positioning portion positions with respect to a direction crossing the axis of the photosensitive drum, the photosensitive drum at a position upstream of said second positioning portion with respect to a mounting direction in which the process cartridge is mounted to said main assembly of said apparatus, wherein said second positioning portion is provided above the process cartridge when the process cartridge is mounted to said main assembly, wherein said second positioning portion is positioned downstream of said first positioning portion with respect to the mounting direction and positions the photosensitive drum with respect to a direction crossing the axis of said photosensitive drum, wherein said main assembly coupling is provided downstream of said first positioning portion with respect to the mounting direction, and engages a drum coupling provided at an end of the photosensitive drum to transmit a driving force to the photosensitive drum when the process cartridge is mounted to said main assembly, and wherein said supporting member supports the process cartridge at a first position that positions the photosensitive drum to contact said first positioning portion and said second positioning portion and at a second position that spaces the photosensitive drum away from said first positioning portion and said second positioning portion to permit mounting and dismounting of the process cartridge relative to said main assembly of said apparatus, said supporting member including a guide portion that engages a portion-to-be-guided provided at a bottom portion of the process cartridge to guide the process cartridge along the mounting direction, and a third positioning portion that limits rotation of the process cartridge relative to said first positioning portion and said second positioning portion when said main assembly coupling transmits a driving force to the drum coupling and that positions the bottom portion of the process cartridge at a position upstream of said second positioning portion with respect to the mounting direction.

2. An apparatus according to claim 1, further comprising:

an opening, provided in said main assembly, that permits mounting and demounting of the process cartridge; and an openable member movable between an open position for opening said opening and a closed position for closing said opening, wherein said supporting member is movable in interrelation with said openable member to the first position when said openable member takes the open position and to the second position when said openable member takes the closed position.

3. An apparatus according to claim 1, wherein said guide portion includes a groove extending in the mounting direction, and wherein said third positioning portion is disposed upstream of said groove.

4. An apparatus according to claim 1, wherein said guide portion is in the form of a projection extending in the mounting direction, and said third positioning portion is disposed upstream of said projection.

5. An apparatus according to claim 1, further comprising a fourth positioning portion that limits rotation of the process cartridge relative to said first positioning portion and said second positioning portion when said main assembly coupling transmits a driving force to the drum coupling, at a position downstream of said third positioning portion with respect to the mounting direction, wherein said fourth positioning portion permits said supporting member to move between the first position and the second position.

6. An apparatus according to claim 5, wherein said fourth positioning portion is in the form of a hole provided in said main assembly of said apparatus and engageable with a projection provided on the process cartridge.

7. An apparatus according to claim 5, wherein said fourth positioning portion is provided on said supporting member.

8. An apparatus according to claim 5, wherein said third positioning portion and the process cartridge are engaged with each other with a first gap therebetween, and said fourth positioning portion and the process cartridge are engaged with each other with a second gap therebetween, wherein the first gap is smaller than the second gap.

9. An apparatus according to claim 1, wherein said apparatus further comprises a plurality of such supporting members, each supporting one of a plurality of such process cartridges, which are detachably mountable to said main assembly.

10. A process cartridge detachably mountable to a main assembly of an image forming apparatus, the main assembly including a main assembly coupling, a first positioning portion, a second positioning portion, a guide portion, and a third positioning portion, said process cartridge comprising:

a photosensitive drum;

a drum coupling, provided at an end of said photosensitive drum, for engagement with the main assembly coupling at one lengthwise end side of said process cartridge with respect to a direction of an axis of said photosensitive drum;

a first portion-to-be-positioned to be positioned with respect to a direction crossing with the axis of said photosensitive drum by contacting to the first positioning portion at the other lengthwise end side of said process cartridge with respect to the direction of the axis of said photosensitive drum;

a second portion-to-be-positioned to be positioned with respect to a direction crossing with the axis of said photosensitive drum by contacting to the second positioning portion at one lengthwise end side of said process cartridge with respect to the direction of the axis of said photosensitive drum;

a portion-to-be-guided engageable with the guide portion to be guided in the direction of the axis of said photosensitive drum; and a third portion-to-be-positioned, provided at the other lengthwise end side of said process cartridge with respect to the direction of the axis of said photosensitive drum, for being limited by the third positioning portion to prevent rotation of said process cartridge relative to the first positioning portion and the second positioning portion when the main assembly coupling transmits a driving force to said drum coupling.

11. A process cartridge according to claim 10, wherein said portion-to-be-guided is in the form of a projection extending in the direction of the axis of said photosensitive drum, and said third positioning portion is provided at the other lengthwise end side of said projection.

12. A process cartridge according to claim 11, wherein said third positioning portion has a width larger than a width of said portion-to-be-guided.

13. A process cartridge according to claim 10, wherein said portion-to-be-guided is in the form of a groove extending in the direction of the axis of said photosensitive drum, and said third positioning portion is provided at the other lengthwise end side of said groove.

14. An electrophotographic image forming apparatus for forming an image on a recording material, to which a process cartridge is detachably mountable, said apparatus comprising:

(i) a main assembly coupling;

(ii) a first positioning portion;

(iii) a second positioning portion;

(iv) a guide portion;

(v) a third positioning portion;

(vi) mounting means for detachably mounting a process cartridge, said process cartridge including:

(a) a photosensitive drum;

(b) a drum coupling, provided at an end of said photosensitive drum, for engagement with the main assembly coupling at one lengthwise end side of said process cartridge with respect to a direction of an axis of said photosensitive drum;

(c) a first portion-to-be-positioned to be positioned with respect to a direction crossing with the axis of said photosensitive drum by contacting to the first positioning portion at the other lengthwise end side of said process cartridge with respect to the direction of the axis of said photosensitive drum;

(d) a second portion-to-be-positioned to be positioned with respect to a direction crossing with the axis of said photosensitive drum by contacting to the second positioning portion at one lengthwise end side of said process cartridge with respect to the direction of the axis of said photosensitive drum;

(e) a portion-to-be-guided engageable with the guide portion to be guided in the direction of the axis of said photosensitive drum; and (f) a third portion-to-be-positioned, provided at the other lengthwise end side of said process cartridge with respect to the direction of the axis of said photosensitive drum, for being limited by the third positioning portion to prevent rotation of said process cartridge relative to the first positioning portion and the second positioning portion when the main assembly coupling transmits a driving force to said drum coupling; and (vii) feeding means for feeding the recording material.

* * * * *